US008288066B2

(12) United States Patent
Nagao et al.

(10) Patent No.: US 8,288,066 B2
(45) Date of Patent: Oct. 16, 2012

(54) ELECTROPHOTOGRAPHIC PHOTORECEPTOR AND IMAGE-FORMING APPARATUS

(75) Inventors: Yuka Nagao, Kanagawa (JP); Teruyuki Mitsumori, Kanagawa (JP); Masayuki Hiroi, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 687 days.

(21) Appl. No.: 11/794,724

(22) PCT Filed: Jan. 5, 2006

(86) PCT No.: PCT/JP2006/000045

§ 371 (c)(1),
(2), (4) Date: Jul. 25, 2007

(87) PCT Pub. No.: WO2006/073160

PCT Pub. Date: Jul. 13, 2006

(65) Prior Publication Data

US 2008/0193867 A1 Aug. 14, 2008

(30) Foreign Application Priority Data

Jan. 5, 2005 (JP) ..... P2005-000991

(51) Int. Cl.
*G03G 5/00* (2006.01)

(52) U.S. Cl. ..... 430/77; 430/58.75; 430/59.3; 430/59.4; 399/116

(58) Field of Classification Search ..... 430/77, 430/58.75, 59.3, 59.4; 599/116
See application file for complete search history.

(56) References Cited

FOREIGN PATENT DOCUMENTS

| | | | |
|---|---|---|---|
| JP | 48-37149 | | 6/1973 |
| JP | 54-60927 | | 5/1979 |
| JP | 56-36656 | | 4/1981 |
| JP | 63-257762 | | 10/1988 |
| JP | 2-190864 | | 7/1990 |
| JP | 8-146629 | | 6/1996 |
| JP | 9-43879 | | 2/1997 |
| JP | 2000-105479 | | 4/2000 |
| JP | 2004-078148 | * | 3/2004 |
| JP | 2005-99234 | | 4/2005 |
| JP | 2005-284268 | * | 10/2005 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

To provide an electrophotographic photoreceptor having a high sensitivity, a good balance of various electric properties such as chargeability and residual potential, a good stability of the coating solution, and an excellent light resistance.

An electrophotographic photoreceptor comprising an electroconductive support having thereon a photosensitive layer, wherein the photosensitive layer contains a compound represented by the following formula (1):

(1)

(wherein $R^1$ represents a group having a chiral center, $R^2$ represents a hydrogen atom, an alkyl group which may have a substituent, or an aryl group which may have a substituent, $R^3$ and $R^4$ each independently represents an alkylene group which may have a substituent, or an arylene group which may have a substituent, and $R^5$, $R^6$, $R^7$ and $R^8$ each independently represents an alkyl group which may have a substituent, or an aryl group which may have a substituent, and at least one member of $R^5$ to $R^8$ is an aryl group having a substituent).

15 Claims, 2 Drawing Sheets

【Fig. 1】
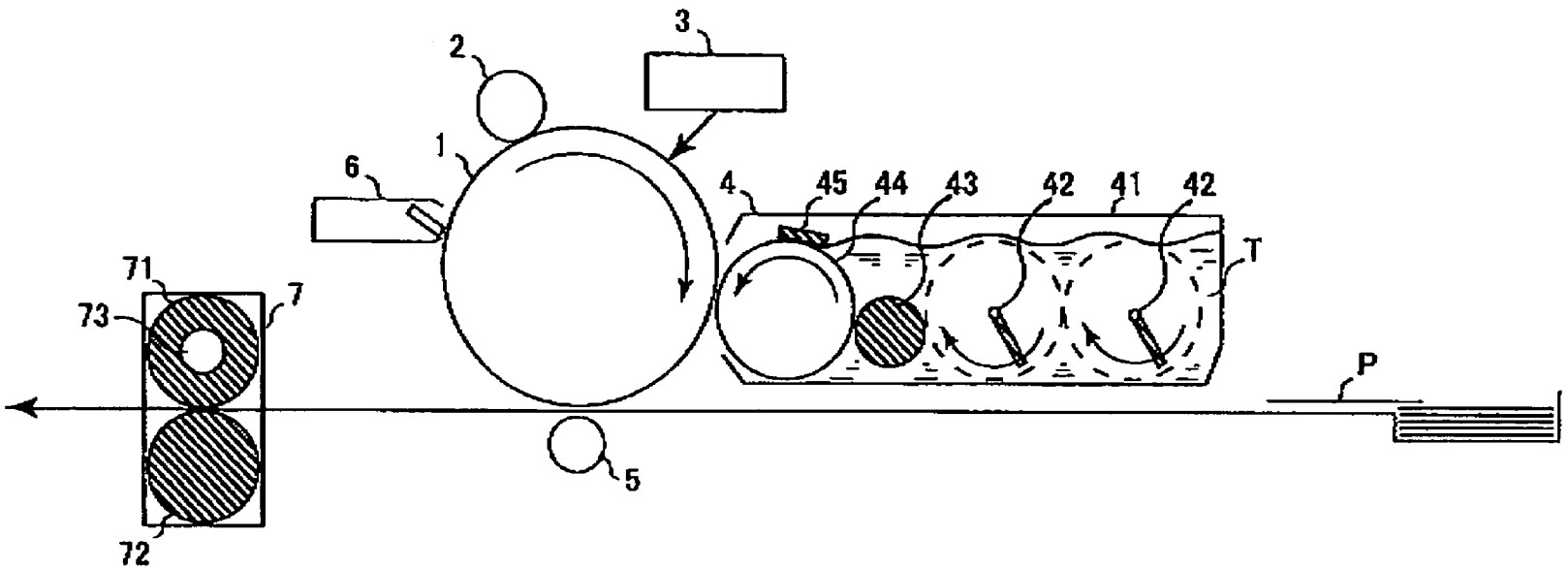

【Fig. 2】
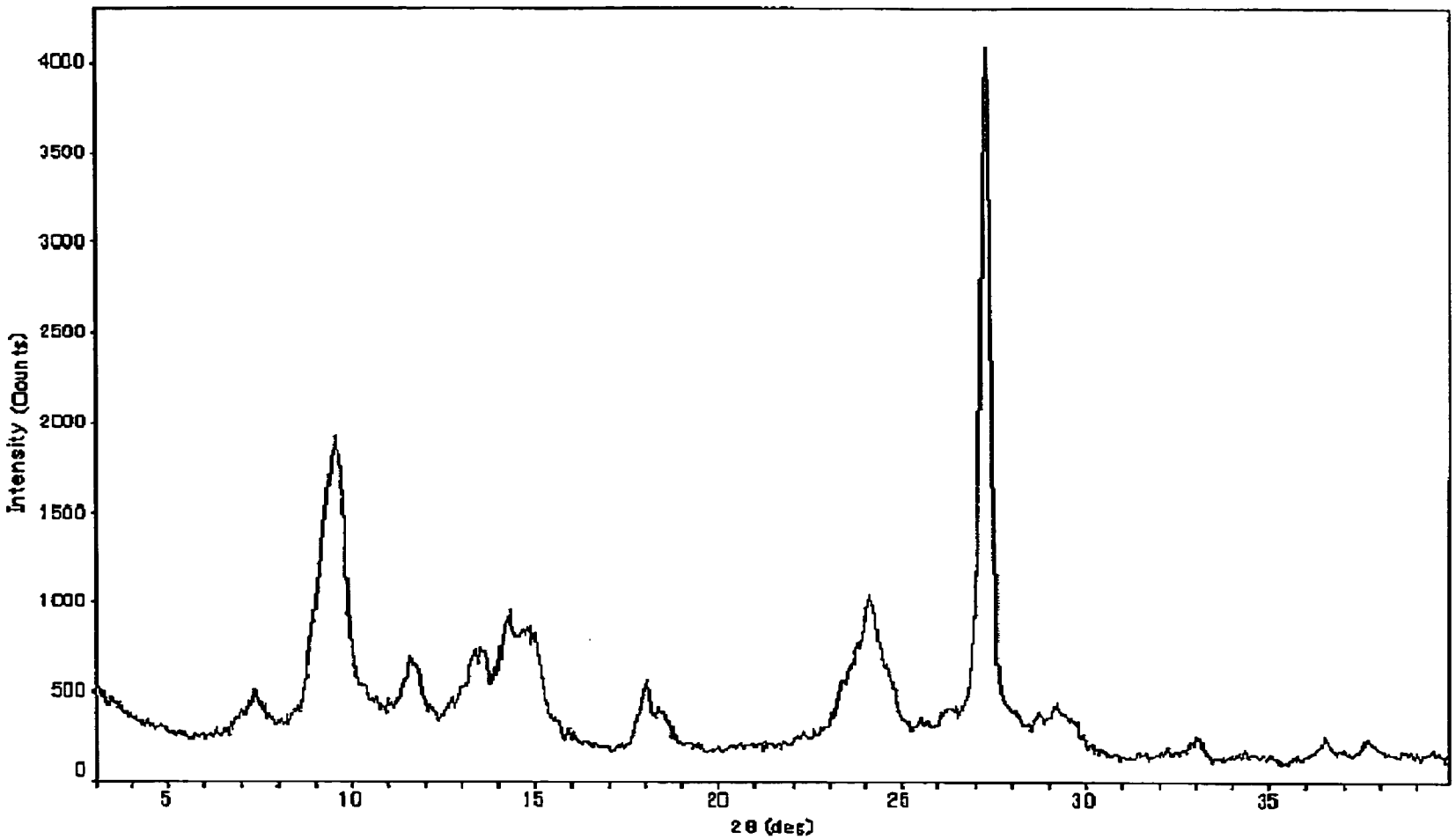

ELECTROPHOTOGRAPHIC PHOTORECEPTOR AND IMAGE-FORMING APPARATUS

DETAILED DESCRIPTION OF THE INVENTION

1. Technical Field to which the Invention Belongs

The present invention relates to an electrophotographic photoreceptor. More specifically, the present invention relates to an electrophotographic photoreceptor which has a photosensitive layer containing an arylamine-based compound having a specific structure, particularly, an azo pigment-containing photosensitive layer, and which is suitably used by exposing it with monochromatic light at 380 to 500 nm.

2. Background Art

Recently, studies on an electrophotographic photoreceptor using an organic photoconductive substance for the photosensitive layer are proceeding and some of these photoreceptors have been put into practical use. The organic photoconductive substance is advantageous as compared with an inorganic substance, for example, in that the weight is light, the film formation and the production of a photoreceptor are easy, a transparent photoreceptor can be produced depending on the type of the substance, and the material is nonpolluting.

In particular, a so-called function-separated photoreceptor where a function of generating a charge carrier and a function of transporting the carrier are assigned to separate compounds is effective in view of high sensitivity and has become the mainstream of development. As for the photosensitive layer of such a function-separated photoreceptor, several layer constructions have been devised, but the photosensitive layer used in general is a so-called lamination-type photoreceptor where a charge generating layer and a charge transport layer are stacked and the charge generating function and the charge transporting function are separated, or a so-called single layer-type photoreceptor where a charge generating substance and a charge transport substance are contained in the same layer.

The charge transport medium includes those using a polymer photoconductive compound such as polyvinyl carbazole and those using a low molecular photoconductive compound dispersed or dissolved in a binder resin. Particularly, in the case of using an organic low molecular photoconductive compound, a polymer excellent in the film formability, flexibility, adhesive property and the like can be selected as the binder resin and therefore, a photoreceptor with excellent mechanical properties can be easily obtained. Also, in order to obtain a suitable photoreceptor well-balanced in various properties such as residual potential, photo-responsivity and fluctuation of chargeability or sensitivity upon repeated use, a technique of providing a well-balanced electrophotographic photoreceptor by using a specific arylamine compound or the like as the charge transport substance has been reported (see, for example, Patent Document 1).

However, when such a conventionally known arylamine-based compound is used as the charge transport substance in the photosensitive layer of an electrophotographic photoreceptor and a coating solution obtained by dissolving or dispersing the charge transport substance in a solvent together with a binder resin or the like is coated and dried on an electroconductive support to form a photosensitive layer, there arises a problem that, for example, non-uniform dispersion with respect to the binder resin or crystal precipitation occurs in the photosensitive layer, as a result, the obtained electrophotographic photoreceptor can hardly have desired electric and image properties and at the same time, various properties are deteriorated by repeated use. Also, the storage stability of the coating solution containing a compound having poor solubility in the solvent is bad, and crystal precipitation, serious increase of viscosity or separation of components is readily caused during storage. Therefore, it has been difficult to industrially form a photosensitive layer containing such a compound by coating and drying the coating solution. Furthermore, there is a problem that when the photoreceptor is incorporated into an image forming apparatus, the photoreceptor is exposed to exterior light at the maintenance of the image forming apparatus and thereby greatly damaged, and many charge traps are produced in the photoreceptor, giving rise to reduction in the photoreceptor performance.

On the other hand, an electrophotographic apparatus using monochromatic light, typically LED, laser or the like, as the exposure light for the photoreceptor is known. In such an electrophotographic apparatus, a light source having a relatively long wavelength of approximately from 600 to 800 nm is predominantly used as the exposure light.

Recently, demands for a high-resolution output image are increasing and use of exposure light having a short wavelength is being studied. When exposure light having a short wavelength is used, since the effect by the field curvature of the scanning lens can be reduced, small-diameter laser spots can be made uniform relatively with ease and this is effective for high resolution. With the progress of technology, a light source having a wavelength around 400 nm starts being applied and the demand for a practical electrophotographic photoreceptor responding to the short-wavelength exposure technology is abruptly increasing in recent years.

In the case of using short-wavelength light for the exposure light, unlike a photoreceptor adapted to long-wavelength light conventionally employed, a photoreceptor with excellent electric properties, typically sensitivity to short-wavelength light, needs to be used. In an electrophotographic apparatus using a laser of relatively long wavelength, a phthalocyanine compound having good sensitivity to long-wavelength light is mainly used as the charge generating substance. Also, many of charge transport substances used at present in the organic photoreceptor have absorption for short-wavelength light and therefore, when such a charge transport substance is used in the photoreceptor to be exposed to short-wavelength light, this sometimes causes reduction of sensitivity or resolution.

With respect to the charge generating substance suitable for exposure with short-wavelength light, azo compounds having various structures have been proposed as the charge generating substance in the photoreceptor of an electrophotographic apparatus using a semiconductor laser light source of emitting light at a wavelength of 380 to 500 nm (see, for example, Patent Document 2). Also, various charge transport substances suitable for exposure with short-wavelength light have been proposed (see, for example, Patent Documents 3 and 4).

Patent Document 1: JP-A-59-194393 (the term "JP-A" as used herein means an "unexamined published Japanese patent application")

Patent Document 2: JP-A-6-324502

Patent Document 3: JP-A-2000-105478

Patent Document 4: JP-A-2001-350282

DISCLOSURE OF THE INVENTION

Problems to be Solved by the Invention

The present invention has been made by taking into consideration the above-described conventional techniques and an object of the present invention is to provide an electrophotographic photoreceptor which has, by virtue of the compound represented by formula (1) having excellent solubility in a solvent or excellent compatibility when used by mixing it with other materials, a good stability of the coating solution for forming the photosensitive layer and less occurrence of crystallization in the photosensitive layer of the electrophotographic photoreceptor and at the same time, excellent properties as the electrophotographic photoreceptor, a high sensitivity, a good balance of various electric properties such as chargeability and residual potential, and a high light resistance, particularly a high sensitivity to light at a wavelength of 380 to 500 nm. Another object of the present invention is to provide a high-performance image forming apparatus capable of forming a good image even by the exposure with light at a wavelength of 380 to 500 nm.

Means for Solving the Problems

As a result of intensive studies, the present inventors have found that an electrophotographic photoreceptor having a photosensitive layer containing a specific arylamine-based compound is suitable as the electrophotographic photoreceptor capable of satisfying the above-described objects. The present invention has been accomplished based on this finding.

A first gist of the present invention resides in an electrophotographic photoreceptor comprising an electroconductive support having thereon a photosensitive layer, wherein the photosensitive layer contains a compound represented by the following formula (1):

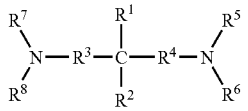

(1)

(wherein $R^1$ represents a group having a chiral center, $R^2$ represents a hydrogen atom, an alkyl group which may have a substituent, or an aryl group which may have a substituent, $R^3$ and $R^4$ each independently represents an alkylene group which may have a substituent, or an arylene group which may have a substituent, and $R^5$, $R^6$, $R^7$ and $R^8$ each independently represents an alkyl group which may have a substituent, or an aryl group which may have a substituent, and at least one of $R^5$ to $R^8$ is an aryl group having a substituent).

A second gist of the present invention resides in the electrophotographic photoreceptor, wherein the photosensitive layer contains a compound represented by formula (1) and at the same time, contains an azo pigment.

A third gist of the present invention resides in the electrophotographic photoreceptor, wherein the photosensitive layer contains a compound represented by formula (1) and at the same time, contains a compound represented by the following formula (3);

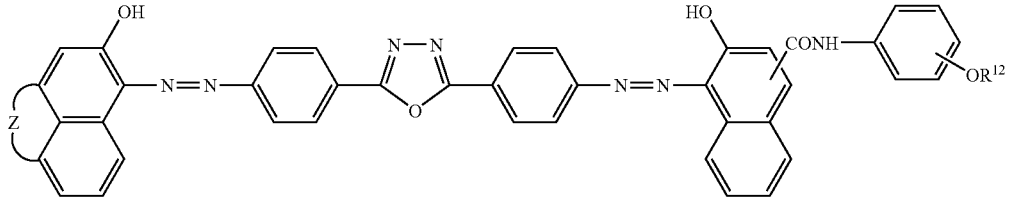

(3)

(wherein $R^{12}$ represents an alkyl group having a total carbon number of 4 to 20 and having a cycloalkyl group which may have an alkyl substituent, and Z represents

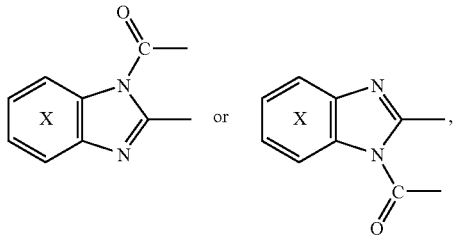

provided that the ring X may have a substituent).

A fourth gist of the present invention resides in the electrophotographic photoreceptor, wherein the photosensitive layer contains a compound represented by formula (1), an azo pigment and a phthalocyanine pigment together.

A fifth gist of the present invention resides in an image forming apparatus, wherein an image is formed by exposing the electrophotographic photoreceptor of the present invention with monochromatic light at a wavelength of 380 to 500 nm.

Advantage of the Invention

According to the present invention, a photoreceptor having a high sensitivity, a low residual potential and a high chargeability can be provided, where fluctuation of these electric properties due to exposure to strong light is small, particularly, the charging stability affecting the image density is good and the durability is excellent. Also, the coating solution for the formation by coating used to form the photosensitive layer has excellent stability, and a high-performance image forming apparatus can be provided, which exhibits a high sensitivity in the region of 380 to 500 nm and particularly, uses an exposure means comprising a semiconductor laser or LED capable of emitting monochromatic light in that region is used.

BRIEF DESCRIPTION OF THE DRAWINGS

FIG. 1 A schematic view showing the main part construction in one embodiment of the image forming apparatus equipped with the electrophotographic photoreceptor of the present invention.

FIG. 2 An X-ray diffraction pattern of oxytitanium phthalocyanine used in Examples.

DESCRIPTION OF REFERENCE NUMERALS AND SIGNS

1 Photoreceptor
2 Charging device (charging roller)
3 Exposure device
4 Development device
5 Transfer device
6 Cleaning device
7 Fixing device
41 Developing tank
42 Agitator
43 Feed roller
44 Developing roller
45 Regulating member
71 Upper fixing member (pressure roller)
72 Lower fixing member (fixing roller)
73 Heating device
T Toner
P Recording paper (sheet, medium)

BEST MODE FOR CARRYING OUT THE INVENTION

The embodiments of the present invention are described below by referring to representative examples, but the present invention can be implemented by making modification within the range not departing from the purport of the present invention, and the present invention is not limited to those described below.

<Compound Represented by Formula (1)>

The electrophotographic photoreceptor of the present invention has a photosensitive layer containing a compound represented by the following formula (1):

(1)

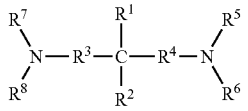

In formula (1), $R^1$ represents a group having a chiral center, $R^2$ represents a hydrogen atom, an alkyl group which may have a substituent, or an aryl group which may have a substituent, $R^3$ and $R^4$ each independently represents an alkylene group which may have a substituent, or an arylene group which may have a substituent, and $R^5$, $R^6$, $R^7$ and $R^8$ each independently represents an alkyl group which may have a substituent, or an aryl group which may have a substituent, provided that at least one member of $R^5$ to $R^8$ is an aryl group having a substituent).

As for the compound represented by formula (1), only one species may be used or some species may be used in combination. Also, another charge transport substance may be further used in combination with the compound represented by formula (1), if desired. The amount of the charge transport substance used in combination is not particularly limited but in order to satisfactorily obtain the effect of the present invention, the total weight of the charge transport substance used in combination and contained in the photosensitive layer is preferably not in excess of the weight of the compound represented by formula (1).

The group having a chiral center of $R^1$ is preferably a group where the chiral center is a carbon atom. The group bonded to the chiral center in $R^x$ is not particularly limited unless it is a group known to worsen the electric properties, such as carbonyl group, alkoxycarbonyl group and nitro group. The group bonded to the chiral center in $R^1$ is preferably a hydrogen atom, an alkyl group which may have a substituent, an alkenyl group which may have a substituent, an alkynyl group which may have a substituent, and an aryl group which may have a substituent, more preferably a hydrogen atom, an alkyl group which may have a substituent, or an alkenyl group which may have a substituent, still more preferably a hydrogen atom or an alkyl group which may have a substituent. The alkyl group preferably has a carbon number of 1 to 17, more preferably a carbon number of 1 to 5. Examples of the substituent of the above-described alkyl group, alkenyl group, alkynyl group and aryl group include a hydroxyl group, an alkyl group which may have a substituent, such as methyl group, ethyl group and propyl group, an aryl group which may have a substituent, such as phenyl group and naphthyl group, and an arylthio group which may have a substituent, such as phenylthio group. Examples of the substituent of these groups include an alkyl group such as methyl group, and a halogen atom such as fluorine atom.

The group having at least one chiral center of $R^1$ is preferably a group represented by the following formula (2):

(2)

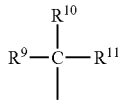

In formula (2), $R^9$, $R^{10}$ and $R^{11}$ are groups different from each other and each represents a hydrogen atom, an alkyl group which may have a substituent, or an alkenyl group which may have a substituent. In particular, it is preferred that two members out of $R^9$ to $R^{11}$ are an alkyl group which may have a substituent and one member is a hydrogen atom.

In formula (1), $R^2$ represents a hydrogen atom, an alkyl group which may have a substituent, or an aryl group which may have a substituent, and is preferably a hydrogen atom or an alkyl group which may have a substituent, more preferably a hydrogen atom. Examples of the substituent which the alkyl group and aryl group may have are the same as those of the substituent described above in $R^1$.

In formula (1), $R^3$ and $R^4$ each independently represents an alkylene group which may have a substituent, or an arylene group which may have a substituent, and is preferably an arylene group which may have a substituent, more preferably a phenylene group, still more preferably a 1,4-phenylene group. Examples of the substituent which the alkylene group and arylene group may have are the same as those of the substituent described above in $R^1$.

In formula (1), $R^5$, $R^6$, $R^7$ and $R^8$ each independently represents an alkyl group which may have a substituent, or an aryl group which may have a substituent. Here, at least one member of $R^5$ to $R^8$ is an aryl group having a substituent. Other three members may be either an alkyl group which may have a substituent, or an aryl group which may have a substituent, and each is preferably an aryl group which may have a substituent. It is more preferred that other three members all are an aryl group which may have a substituent. Specific examples of the aryl group include a phenyl group and a naphthyl group. Examples of the substituent thereof are the same as those of the substituent described above in $R^1$. In particular, an alkyl group is preferred, and a tolyl group and a xylyl group each having a substituted methyl group at the 3-position and/or 4-position with respect to the carbon atom bonded to the nitrogen atom are more preferred. Specific suitable examples of the arylamine-based compound represented by formula (1) for use in the present invention are set forth below.

1

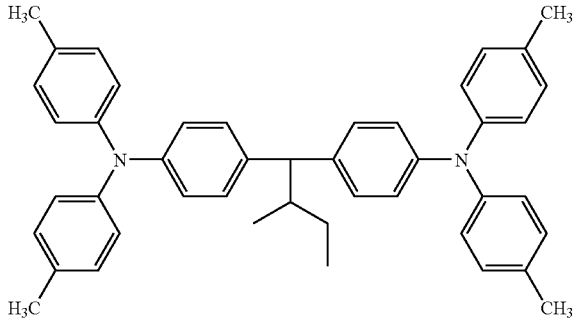

-continued
2
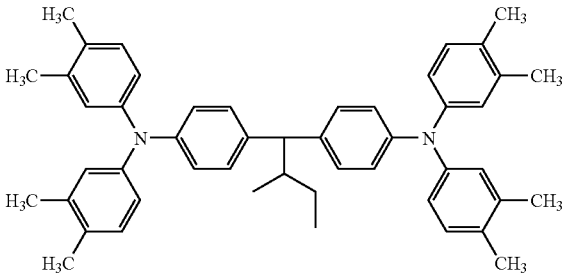
3
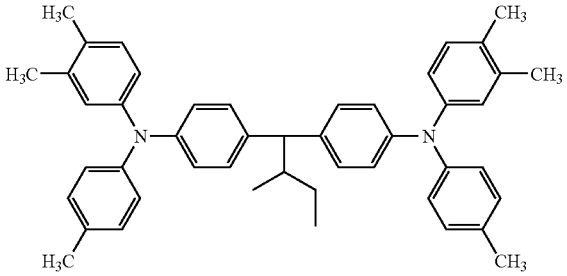
4
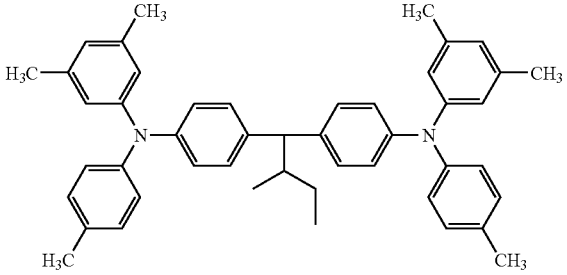
5
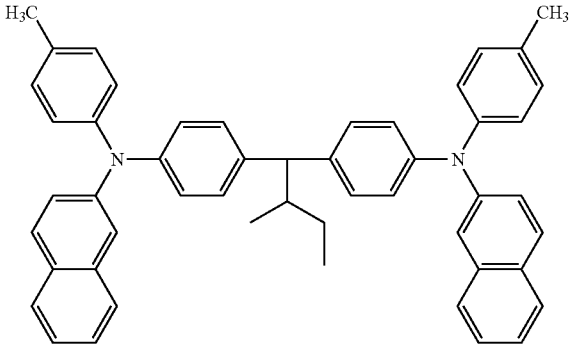
6
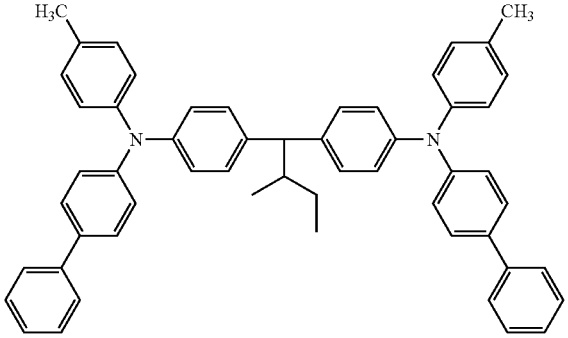
-continued
7
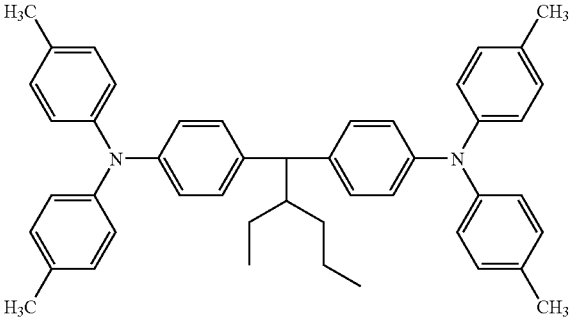
8
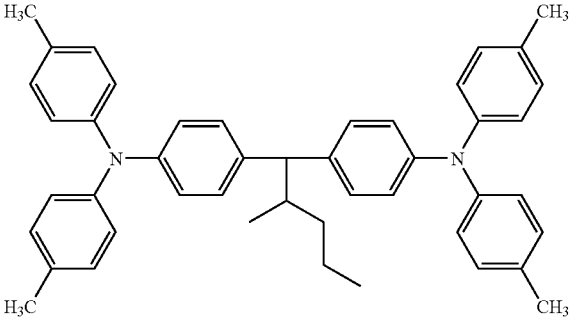
9
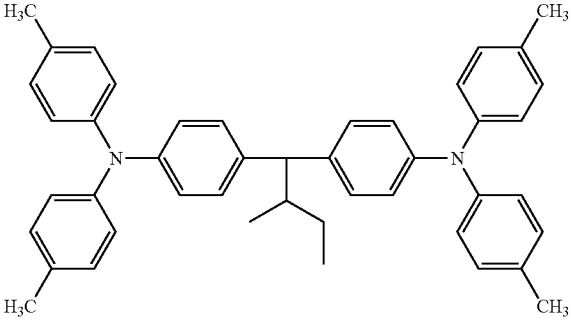
10
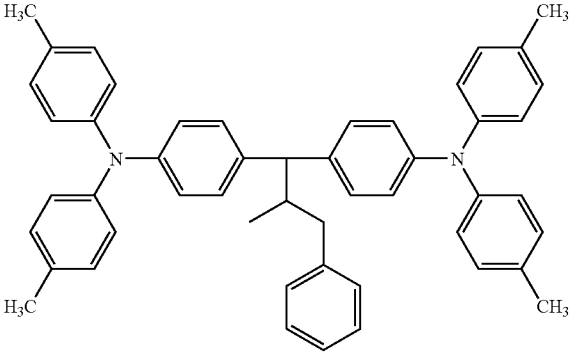

-continued
11
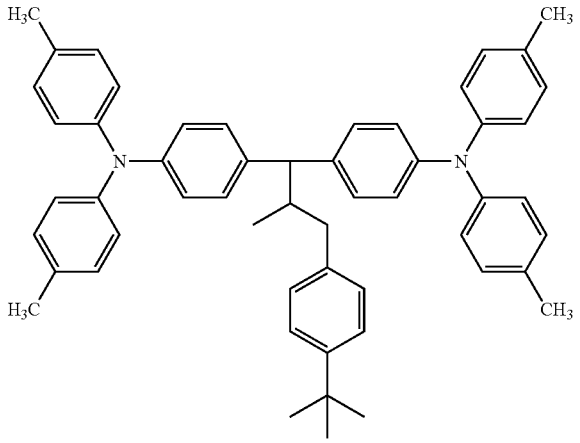
12
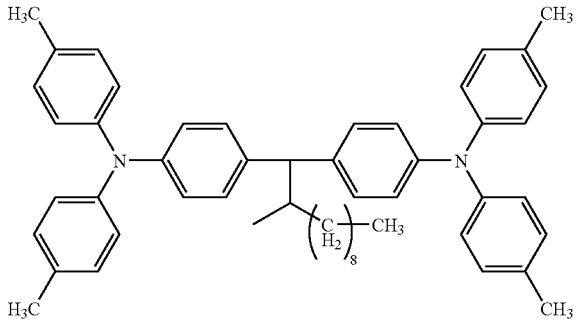
13
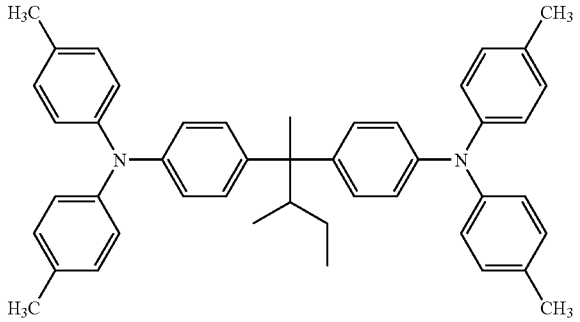
14
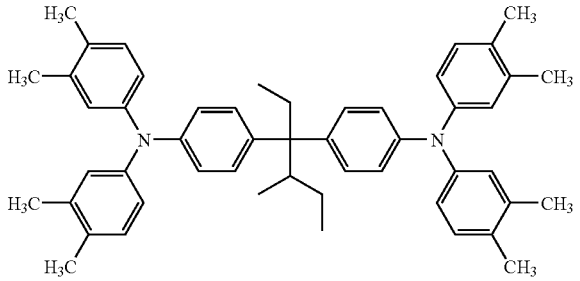
-continued
15
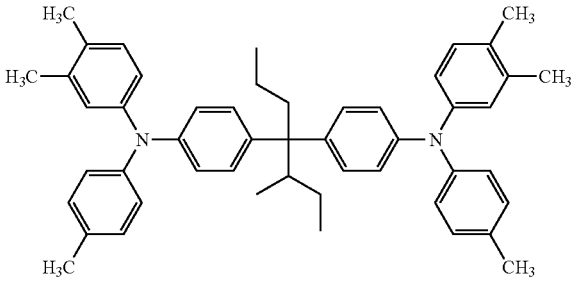
16
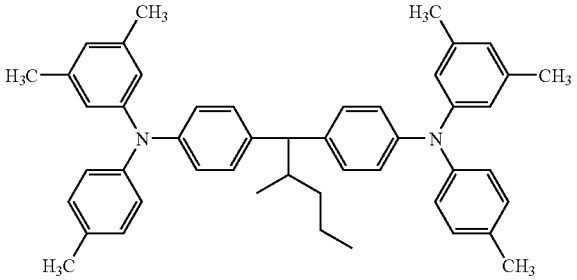
17
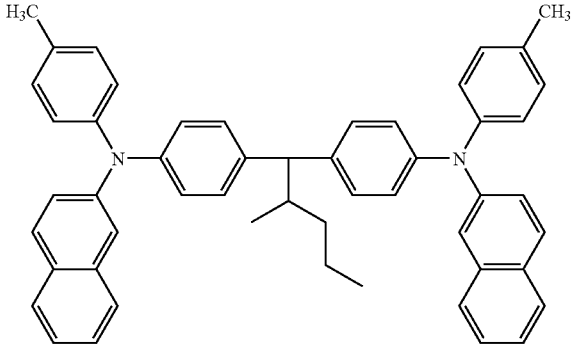
18
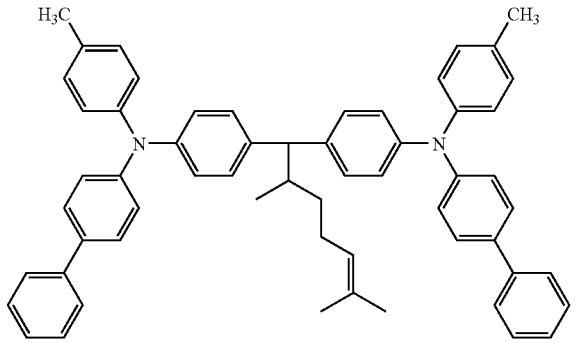

-continued
19
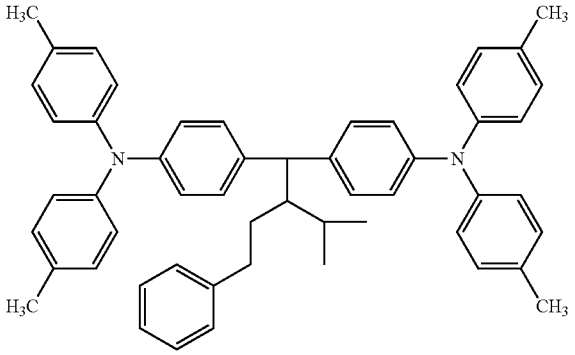
20
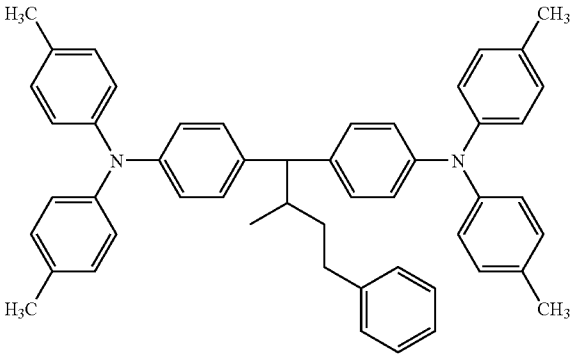
21
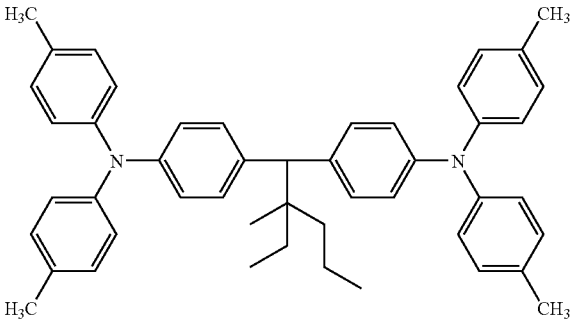
22
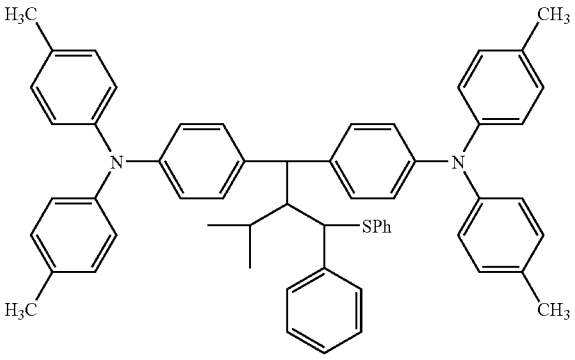
-continued
23
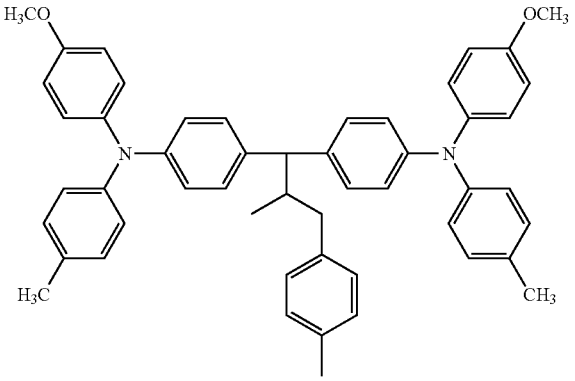
24
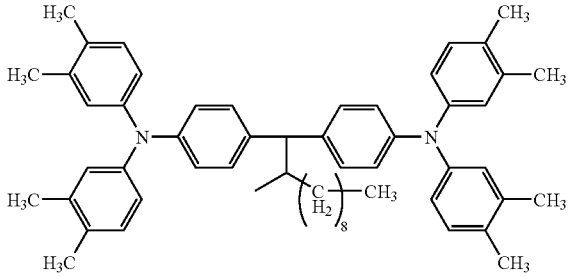
25
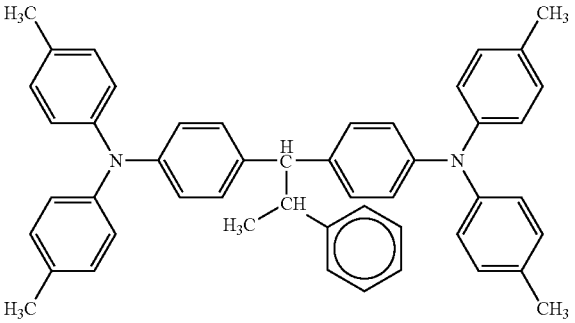
26
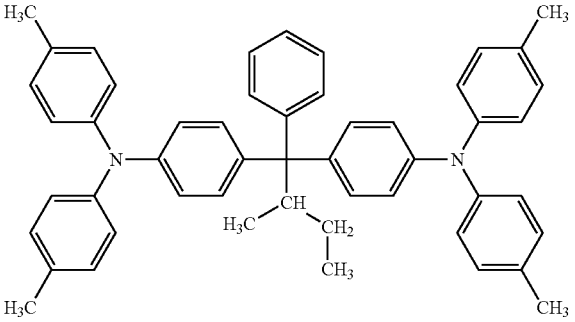

-continued

27

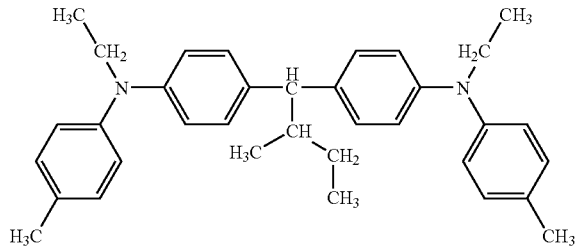

These arylamine-based compounds can be produced, for example, by a method where a tertiary amine compound having $R^4$, $R^5$ and $R^6$ of formula (1) as substituents, a tertiary amine compound having $R^3$, $R^7$ and $R^8$ as substituents and a carbonyl compound having $R^1$ and $R^2$ are reacted by acid condensation, or a method where a secondary amine compound having $R^3$ and $R^5$ of formula (1) as substituents, a secondary amine compound having $R^4$ and $R^7$ as substituents and a cazbonyl compound having $R^1$ and $R^2$ are reacted by acid condensation and then further reacted by coupling with a halogen compound having $R^6$ and a halogen compound having $R^8$.

At this time, the coupling reaction may be performed by a Ullmann reaction using a copper or iron catalyst or by a method using a palladium catalyst, but considering the electric properties when the arylamine-based compound of the present invention is used for an electrophotographic photoreceptor, the reaction is preferably performed by a method using a palladium catalyst. The ligand of the palladium catalyst is preferably a phosphorus derivative. Also, in this reaction, water, acid, alcohol and the like produced are preferably discharged out of the system at an early stage and in particular, the reaction is preferably performed, for example, under nitrogen stream. The amount of nitrogen flowed is preferably from 0.0001 to 5 vol %/min, more preferably from 0.001 to 3 vol %/min, based on the reaction vessel.

<Electrophotographic Photoreceptor>

A Layer Construction

The electrophotographic photoreceptor of the present invention has a photosensitive layer on an electroconductive support. As for the construction of the photosensitive layer constituting the electrophotographic photoreceptor, any conventionally known construction may be used, but specific examples of the construction include a lamination-type photoreceptor where a layer containing a charge generating substance and a layer containing a charge transport substance are stacked, and a single layer-type photoreceptor where a charge generating substance is dispersed in a charge transport substance-containing layer. The lamination-type photoreceptor includes a forward lamination-type photoreceptor where a charge generating layer and a charge transport layer are stacked in this order from the support side, and a reverse lamination-type photoreceptor where these layers are stacked in reverse order, and in the present invention, either construction of the photosensitive layer may be used, but a forward lamination-type photoreceptor capable of exerting optimally balanced photoconductivity is preferred.

In either type, the photosensitive layer contains the compound represented by formula (1) of the present invention. Usually, the compound represented by formula (1) is used as a charge transport substance, but this is not particularly limited and another compound may be used in combination. In general, even when used in a single layer-type photoreceptor or when used in a lamination-type photoreceptor, the charge transport substance is known to exhibit equal performance with respect to the function of transporting a charge.

Support

Examples of the electroconductive support which is mainly used include a metal material such as aluminum, aluminum alloy, stainless steel, copper and nickel; a resin material imparted with electrical conductivity by adding thereto an electroconductive powder such as metal, carbon and tin oxide; and a resin, glass or paper having vapor-deposited or coated on the surface thereof an electroconductive material such as aluminum, nickel and ITO (indium oxide-tin oxide alloy). As for the support shape, a support having a shape of drum, sheet, belt or the like is used. An electroconductive support formed of a metal material, on which an electroconductive material having an appropriate resistance value is coated so as to control the electrical conductivity, surface property and the like or cover a defect, may also be used.

In the case of using a metal material such as aluminum alloy for the electroconductive support, the support may be used after applying an anodic oxide film. When an anodic oxide film is applied, a pore-sealing treatment is preferably performed by a known method.

For example, an anodic oxide film is formed by performing an anodization treatment in an acidic bath such as chromic acid, sulfuric acid, oxalic acid, boric acid and sulfamic acid, but good results are obtained by an anodization treatment in sulfuric acid. In the case of anodization in sulfuric acid, the conditions are preferably set, but not limited, to a sulfuric acid concentration of 100 to 300 g/l, a dissolved aluminum concentration of 2 to 15 g/l, a liquid temperature of 15 to 30° C., an electrolysis voltage of 10 to 20 V and a current density of 0.5 to 2 A/dm$^2$.

The thus-formed anodic oxide film is preferably subjected to a pore-sealing treatment. The pore-sealing treatment may be performed by a known method, but a low-temperature pore-sealing treatment of dipping the film in an aqueous solution containing nickel fluoride as the main component, or a high-temperature pore-sealing treatment of dipping the film in an aqueous solution containing nickel acetate as the main component is preferred.

The concentration of the aqueous nickel fluoride solution used in the low-temperature pore-sealing treatment may be appropriately selected, but when the aqueous solution is used at a concentration of 3 to 6 g/l, good results are obtained. In order to allow the pore-sealing treatment to smoothly proceed, the treatment temperature is preferably from 25 to 40° C., more preferably from 30 to 35° C., and the pH of the aqueous nickel fluoride solution is preferably from 4.5 to 6.5, more preferably from 5.5 to 6.0. Examples of the pH adjusting agent which can be used include oxalic acid, boric acid, formic acid, acetic acid, sodium hydroxide, sodium acetate and aqueous ammonia. The treatment time is preferably from 1 to 3 minutes per 1 μm of the film thickness. Incidentally, cobalt fluoride, cobalt acetate, nickel sulfate, a surfactant or the like may be previously added to the aqueous nickel fluoride solution so as to more improve the physical properties of the film. Subsequently, water washing and drying are performed, whereby the low-temperature pore-sealing treatment is completed. In the case of the high-temperature pore-sealing treatment, an aqueous solution of metal salt such as nickel acetate, cobalt acetate, lead acetate, nickel-cobalt acetate or barium nitrate may be used as the sealing agent, but use of nickel acetate is particularly preferred. When an aqueous nickel acetate solution is used, the concentration is preferably from 5 to 20 g/l, the treatment temperature is preferably from 80 to 100° C., more preferably from 90 to 98° C., and the pH of the aqueous nickel acetate solution is preferably from 5.0 to 6.0. Examples of the pH adjusting agent which can be used here include aqueous ammonia and sodium acetate. The treatment time is preferably 10 minutes or more, more preferably 15 minutes or more. Also in this case, sodium acetate, an organic carboxylic acid, an anionic or nonionic surfactant or the like may be added to the aqueous nickel acetate solution so as to improve the physical properties of the film. Furthermore, the film may be treated with high-temperature water or water vapor containing substantially no salts. Subsequently, water washing and drying are performed, whereby the high-temperature pore-sealing treatment is completed. In the case where the average film thickness is large, pore-sealing under stronger conditions is required by elevating the concentration of the pore-sealing solution and performing the treatment at a high temperature for a long time, and this incurs reduction of productivity and ready occurrence of a defect on the film surface, such as stain, dirt and powdery coating. From this standpoint, the anodic oxide film is preferably formed to an average film thickness of usually 20 μm or less, particularly 7 μm or less.

The support surface may be smooth or may be roughened by using a special cutting method or applying a polishing treatment. The roughening may also be achieved by mixing particles having an appropriate particle diameter in the material constituting the support.

In order to improve adhesive property, blocking property and the like, an undercoat layer may be provided between the electroconductive support and the photosensitive layer.

Undercoat Layer

As for the undercoat layer, a resin or a resin having dispersed therein particles of metal oxide or the like is used. Examples of the metal oxide particle used in the undercoat layer include a metal oxide particle containing one metal element, such as titanium oxide, aluminum oxide, silicon oxide, zirconium oxide, zinc oxide and iron oxide, and a metal oxide particle containing a plurality of metal elements, such as calcium titanate, strontium titanate and barium titanate. Only one kind of the particle may be used or several kinds of the particles may be mixed and used. Among these metal oxide particles, titanium oxide and aluminum oxide are preferred, and titanium oxide is more preferred. The surface of the titanium oxide particle may be treated with an inorganic material such as tin oxide, aluminum oxide, antimony oxide, zirconium oxide or silicon oxide, or with an organic material such as stearic acid, polyol or silicone. As for the crystal form of the titanium oxide particle, all of rutile, anatase, brookite and amorphous may be used. Particles having a plurality of crystal states may be contained.

As for the particle diameter of the metal oxide particle, various particles may be utilized but in view of properties and liquid stability, the particle diameter is, in terms of the average primary particle diameter, preferably from 10 to 100 nm, more preferably from 10 to 50 nm.

The undercoat layer is preferably formed using the metal oxide particle in the form of being dispersed in a binder resin. Examples of the binder resin used in the undercoat layer include a phenoxy resin, an epoxy resin, polyvinylpyrrolidone, a polyvinyl alcohol, casein, a polyacrylic acid, celluloses, gelatin, starch, polyurethane, polyimide and polyamide, and such a resin is used in the form of being cured by itself or together with a curing agent. Among these resins, an alcohol-soluble copolymerized polyamide and a modified polyamide are preferred because of their good dispersibility and good coatability.

The mixing ratio of the inorganic particle to the binder resin may be arbitrarily selected but in view of stability and coatability of the liquid dispersion, the mixing ratio is preferably from 10 to 500 wt %.

The film thickness of the undercoat layer may be arbitrarily selected but in view of photoreceptor properties and coatability, the film thickness is preferably from 0.1 to 20 μm. The undercoat layer may contain a known antioxidant and the like.

Charge Generating Substance

As for the charge generating substance, known compounds all are usable and may also be used in combination. Specific examples thereof include an organic photoconductive compound such as phthalocyanine pigment (e.g., nonmetallic phthalocyanine, metal-containing phthalocyanine), perynone-type pigment, thioindigo, quinacridone, perylene-type pigment, anthraquinone-type pigment, azo-type pigment (e.g., bisazo-type pigment, trisazo-type pigment, tetrakis-type azo pigment), cyanine-type pigment, and various organic pigments and dyes (e.g., polycyclic quinone, pyrylium salt, thiopyrylium salt, indigo, anthanthrone, pyranthrone). Among these, a phthalocyanine pigment and an azo pigment are preferred, and an azo pigment is more preferred. Out of azo pigments, those having a plurality of azo bonds are preferred, and a bisazo-type pigment and a trisazo-type pigment are more preferred. Specific examples of the azo pigment suitable as the charge generating substance are set forth below.

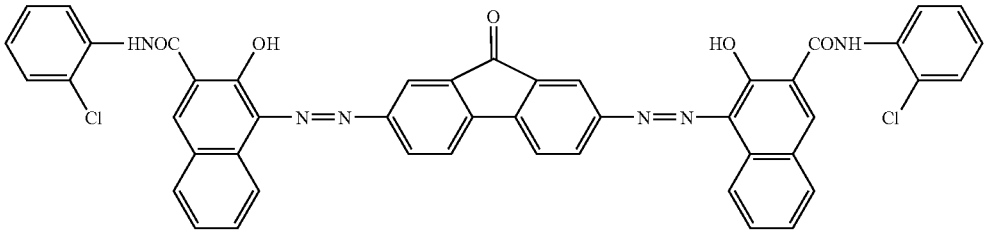

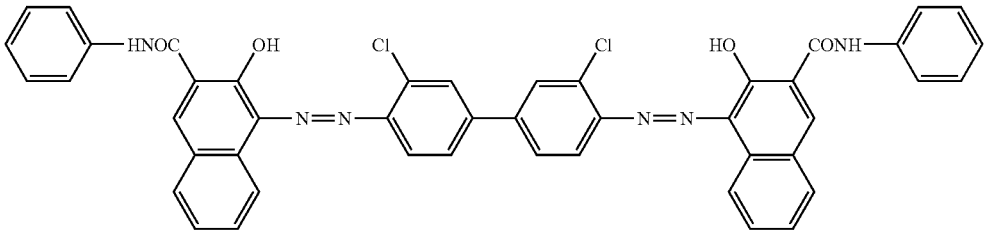

-continued
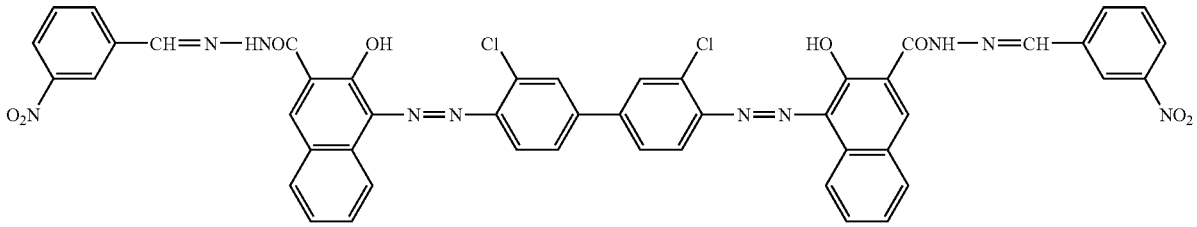
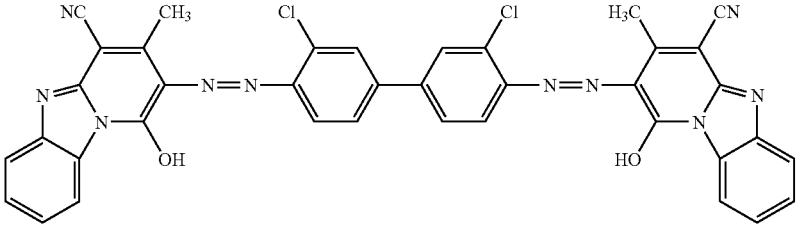
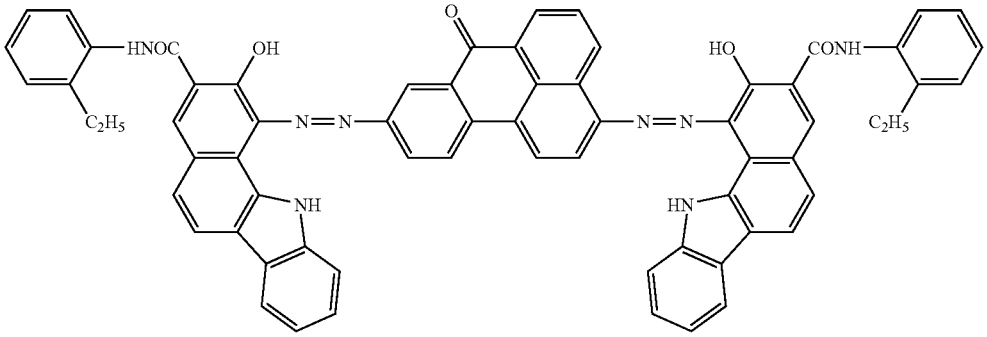
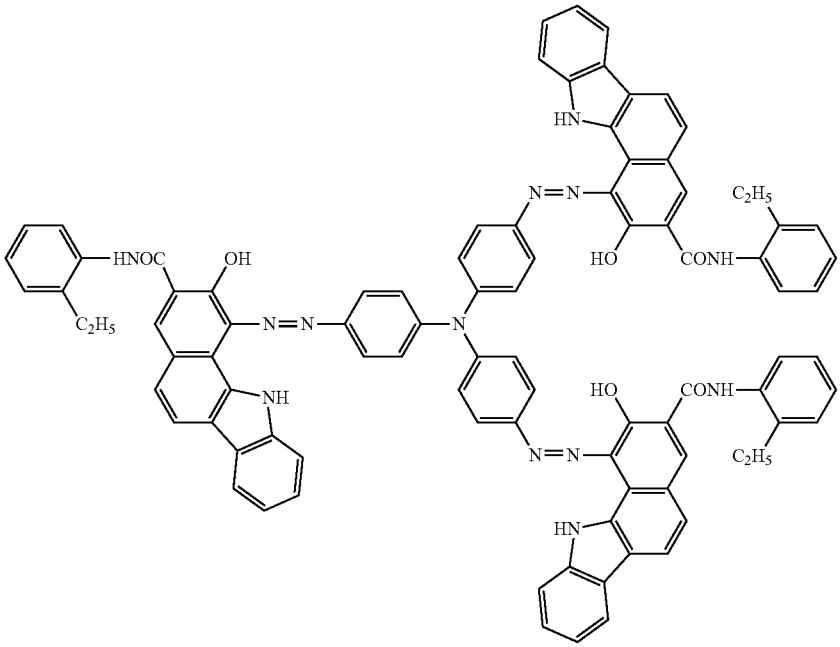

-continued
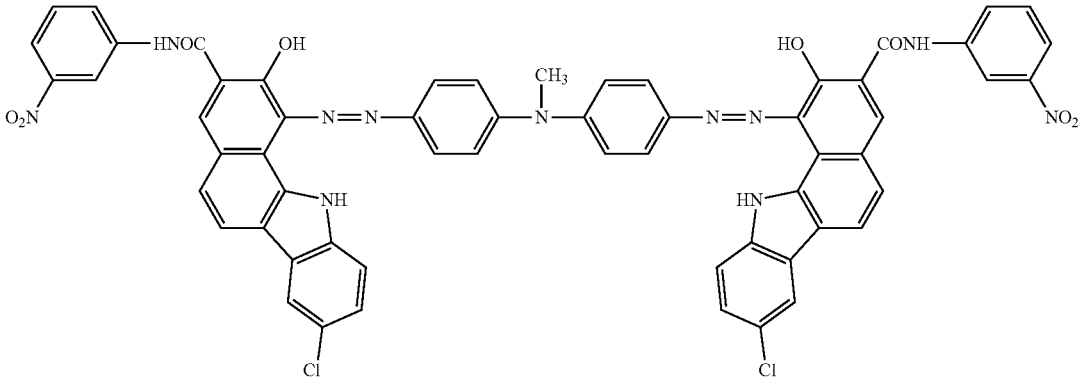
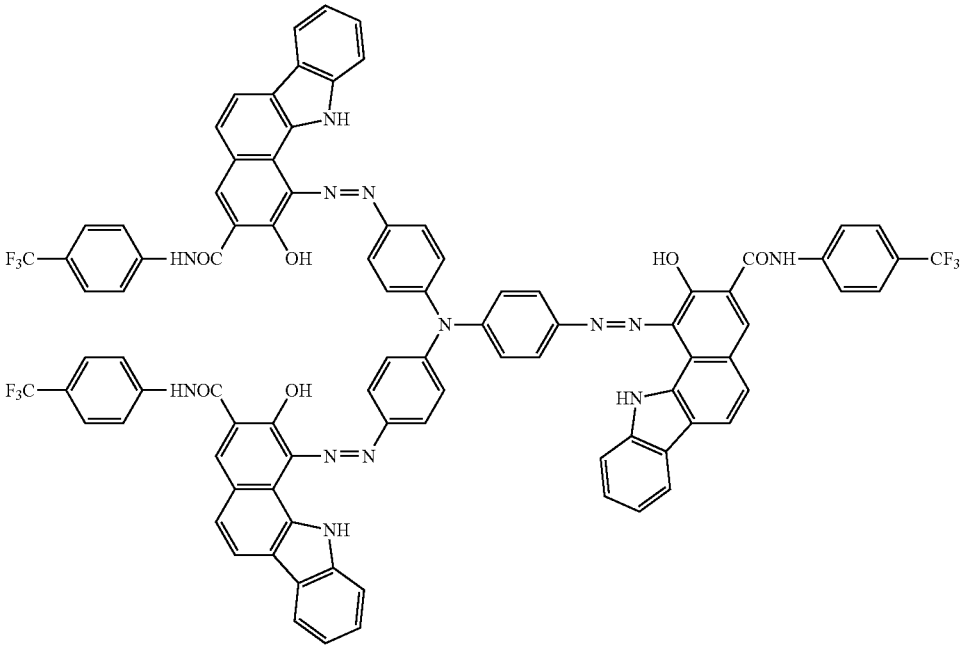
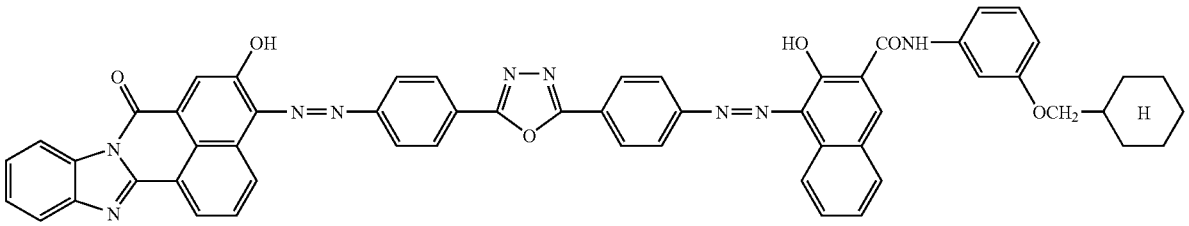
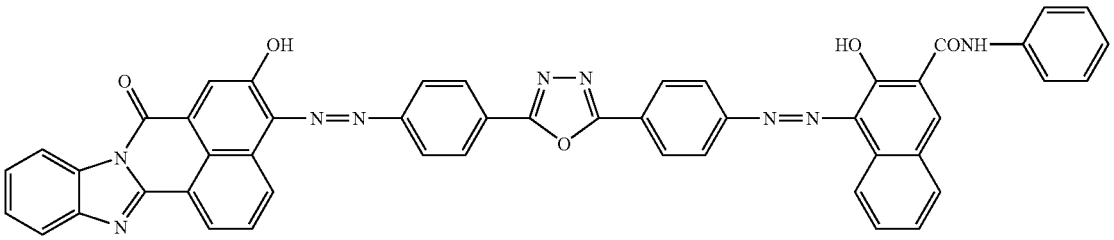
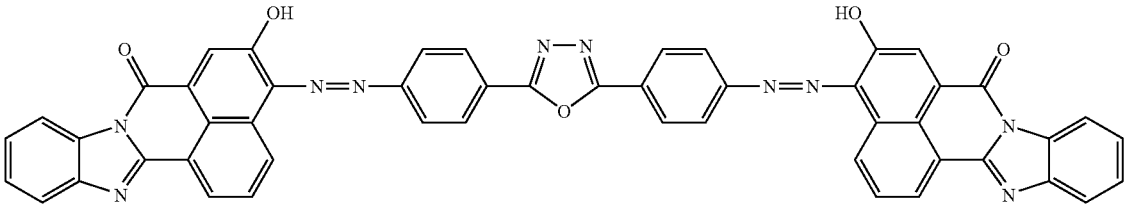

-continued
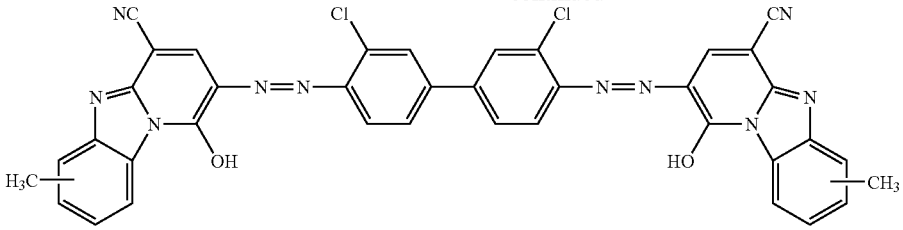
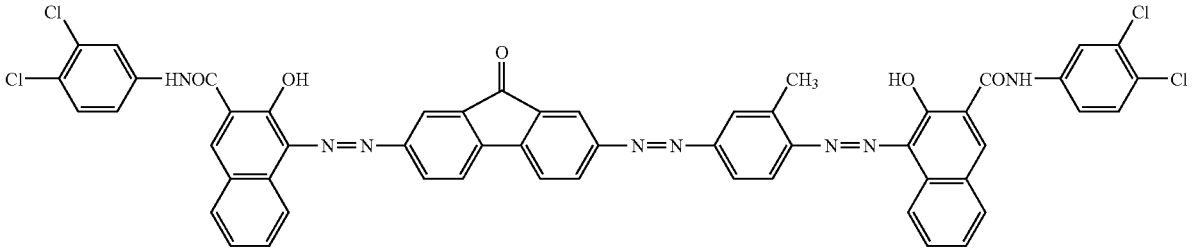
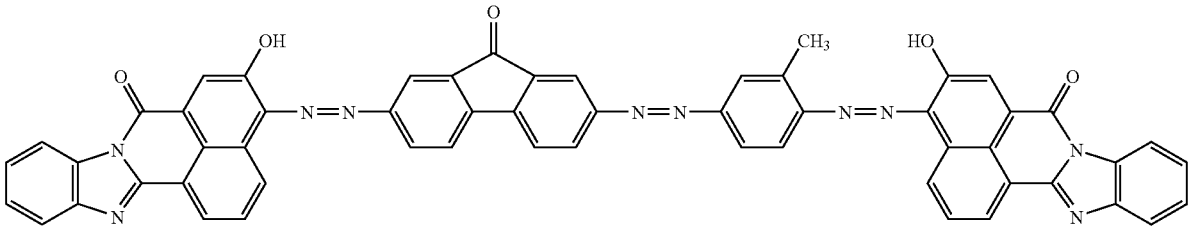
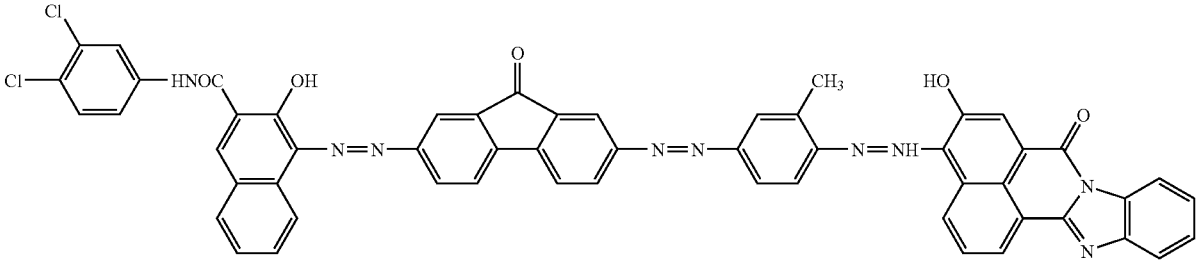
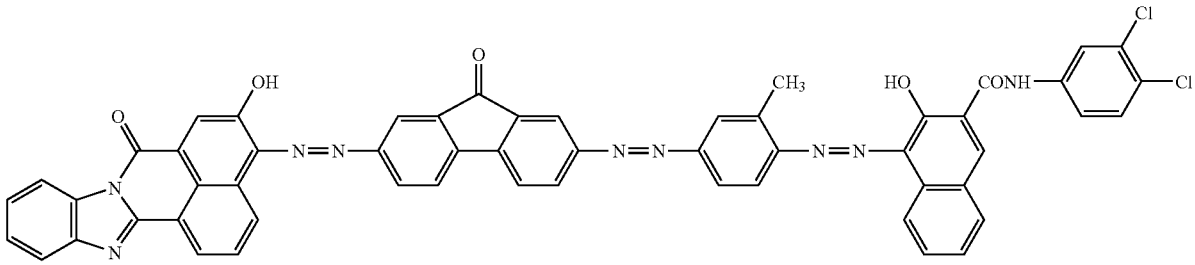
The charge generating substance for use in the electrophotographic photoreceptor of the present invention is particularly preferably a compound represented by the following formula (3);
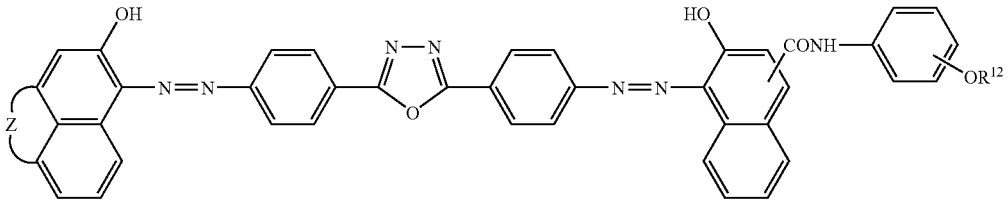
(3)

In formula (3), $R^{12}$ represents an alkyl group having a total carbon number of 4 to 20 and having a cycloalkyl group which may have an alkyl substituent, and Z represents

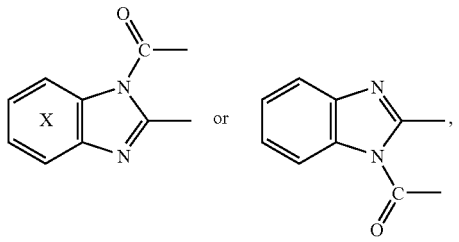

provided that the ring X may have a substituent.

Examples of the substituent which the ring X may have include a halogen atom such as fluorine atom, iodine atom and chlorine atom; an alkyl group such as methyl group, ethyl group, n-propyl group, i-propyl group, n-butyl group and n-hexyl group; and an alkoxy group such as methoxy group, ethoxy group and n-propoxy group. Among these, a fluorine atom, a chlorine atom and a methoxy group are preferred. However, most preferably, a substituent is not present on the benzene ring represented by X.

In formula (3), the —$OR^{12}$ group may be bonded at an arbitrary position but is preferably bonded to the meta-position with respect to the carbon atom to which the —CONH— group is bonded. In the alkyl group having a cycloalkyl group represented by $R^{12}$, the carbon number of the alkyl group moiety is 5 or less, preferably from 1 to 3, and the carbon number of the cycloalkyl group moiety is 8 or less, preferably from 4 to 6. More specifically, $R^{12}$ includes those shown in Table 1 and among these, an alkyl group where the cycloalkyl group moiety is a cyclohexyl group is preferred, and a cyclohexylmethyl group is more preferred.

Incidentally, the —CONH— group may be bonded to the naphthalene at an arbitrary position as long as the position is on the ring to which the —N═N— group is bonded, but the position is preferably the meta-position with respect to the carbon to which the —N═N— group is bonded. Specific examples of the compound represented by formula (3) of the present invention are shown in Table 1 below.

TABLE 1

| | $R^1$ |
|---|---|
| 1-1 | 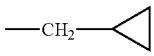 |
| 1-2 | 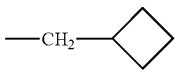 |
| 1-3 | 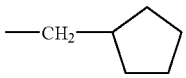 |
| 1-4 | 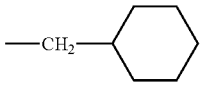 |
| 1-5 | 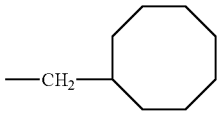 |

TABLE 1-continued

| | $R^1$ |
|---|---|
| 1-6 | 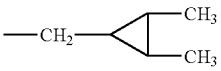 |
| 1-7 | 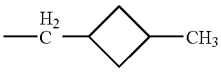 |
| 1-8 | 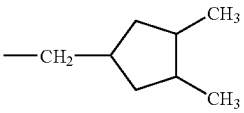 |
| 1-9 | 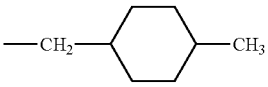 |
| 1-10 | 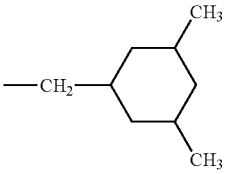 |
| 1-11 | 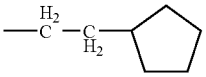 |
| 1-12 | 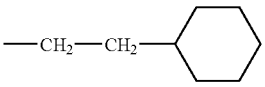 |
| 1-13 | 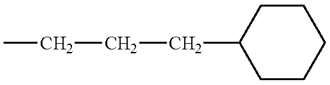 |
| 1-14 | 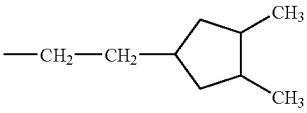 |
| 1-15 | 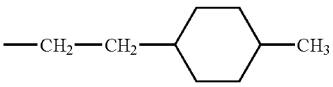 |
| 1-16 | 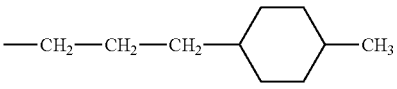 |
| 1-17 | 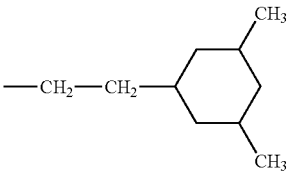 |
| 1-18 | 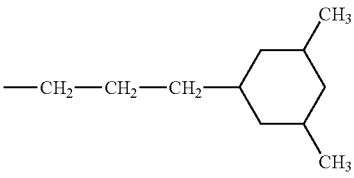 |

As for the compound represented by formula (3), only one species may be used or some species may be used in combination. Also, a charge generating substance other than the compound represented by formula (3) may be further used in combination, if desired. The other charge generating substance used in combination is not particularly limited and unless the properties of the electrophotographic photoreceptor of the present invention are inhibited, any conventionally known compound may be used. The amount of the other charge generating substance used in combination is also not particularly limited but in order to satisfactorily obtain the effect of the present invention, the total weight of the charge generating substance used in combination and contained in the photosensitive layer is preferably not in excess of the weight of the compound represented by formula (3).

In the case of the lamination-type photoreceptor, a charge generating layer containing a charge generating substance is formed. The charge generating layer is usually used in the form such that fine particles of the charge generating substance pulverized by the grinding using a paint shaker, a sand grind mill or a ball mill or by the ultrasonic treatment, stirring or the like are bound by a binder resin of various types, such as polyester, polyvinyl acetate, polyacrylic acid ester, polymethacrylic acid ester, polyester, polycarbonate, polyvinyl acetal, polyvinyl acetoacetal, polyvinyl propional, polyvinyl butyral, polyamide, polyurethane, cellulose ether, phenoxy resin, silicone resin, epoxy resin, urethane resin, cellulose ester, cellulose ether, and polymer or copolymer of a vinyl compound (e.g., butadiene, styrene, vinyl acetate, vinyl chloride, ethyl vinyl ether). In the charge generating layer, the proportion of the charge generating substance is from 30 to 500 parts by weight per 100 parts by weight of the binder resin, and the film thickness is usually from 0.1 to 1 μm, preferably from 0.15 to 0.6 μm. In this case, if the proportion of the compound represented by formula (3) is too small, the charge generating function cannot be satisfactorily exerted, whereas if it is in excess of a given amount, the deterioration of the coating solution for forming the charge generating layer is accelerated. Therefore, the compound is used in an amount of 30 to 500 parts by weight per 100 parts by weight of the binder resin.

Charge Transport Substance

As for the charge transport substance, the compound represented by formula (1) is usually used but unless the effect of the present invention is inhibited, any known compound may be used or may be used in combination. Specific examples thereof include a diphenoquinone derivative, an aromatic nitro compound such as and 2,4,7-trinitrofluorenone, a heterocyclic compound such as carbazole derivative, indole derivative, imidazole derivative, oxazolederivative, pyrazole derivative, oxadiazole derivative, pyrazoline derivative and thiadiazole derivative, a nitrogen-containing compound such as aniline derivative, hydrazone compound and aromatic amine derivative, a stilbene derivative, a butadiene derivative, an enamine compound, a compound obtained by combining a plurality of these compounds, and a polymer having a group comprising such a compound in its main or side chain.

In the case of a lamination-type photoreceptor, a charge transport layer containing a charge transport substance is formed. The charge transport layer may be a single layer or may be formed by stacking a plurality of layers differing in the constituent components or the compositional ratio. Also, in the photosensitive layer of the single layer-type photoreceptor, a charge generating substance is dispersed in a charge transport medium having the same construction as the charge transport layer of the lamination-type photoreceptor. The charge transport layer of the lamination-type photoreceptor and the charge transport medium of the single layer-type photoreceptor are usually obtained by binding the charge transport substance by a binder resin.

In the forward lamination-type photoreceptor and the single layer-type photoreceptor, the light passed through the charge transport layer or photosensitive layer reaches the charge generating substance, whereby each photoreceptor can function. Therefore, the charge transport layer or charge transport medium needs to have excellent transmission of exposure light, and the charge transport substance preferably has high compatibility with the binder resin and causes no precipitation of the constituent component or no turbidity. Also, in order to form a good image, a substance not absorbing exposure light is preferred. The transmittance for exposure light of the charge transport layer or charge transport medium is preferably 87% or more, more preferably 90% or more, still more preferably 93% or more, yet still more preferably 95% or more. This transmittance for exposure light of the charge transport layer or charge transport medium can be achieved by selecting the charge transport substance, for example, by using the compound represented by formula (1) of the present invention as the charge transport substance, and can also be achieved by adjusting the film thickness of the charge transport layer. The transmittance for exposure light may be measured by using any known method but, for example, after forming the charge transport layer on a transparent plate (e.g., quartz glass plate) at the measurement wavelength, the transmittance can be measured by a commercially available spectrophotometer.

As for the ratio between the binder resin and the charge transport substance contained in the charge transport layer of the lamination-type photoreceptor or in the photosensitive layer of the single layer-type photoreceptor, the entire charge transport substance is usually from 30 to 200 parts by weight, preferably from 40 to 150 parts by weight, per 100 parts by weight of the binder resin. The charge transport layer and the photosensitive layer of the single layer-type photoreceptor each usually has a film thickness of 5 to 50 μm, preferably from 10 to 45 μm. If the film thickness is too small, the life of the photoreceptor is shortened by abrasion, whereas if the film thickness is excessively large, the resolution of the image tends to be worsened due to diffusion of exposure light or electric charge.

In order to enhance the film-forming property, flexibility, coatability, contamination resistance, gas resistance, light resistance and the like, known additives such as plasticizer, antioxidant, ultraviolet absorbent, electron withdrawing compound, leveling agent and surfactant (e.g., silicone oil, fluorine-based oil) may be contained. Examples of the antioxidant include a hindered phenol compound and a hindered amine compound.

Examples of the binder resin used in the charge transport layer of the lamination-type photoreceptor or in the photosensitive layer of the single layer-type photoreceptor include a vinyl polymer such as polymethyl methacrylate, polystyrene and polyvinyl chloride, a copolymer thereof, a polycarbonate, a polyester, a polyester carbonate, a polysulfone, a polyimide, a phenoxy resin, an epoxy resin and a silicone resin. Furthermore, a partially crosslinked cured product of such a resin, or a mixture of these resins may also be used.

The binder resin particularly preferably used in the photosensitive layer of the present invention includes a polycarbonate resin having a repeating structure represented by the following formula (4), and a polyester resin having a repeating structure represented by the following formula (5).

$$-\!\!\left[O-Ar^{13}-Q-Ar^{14}-OC(=O)\right]\!\!- \quad (4)$$

$$-\!\!\left[O-Ar^{13}-Q-Ar^{14}-OC(=O)-Ar^{15}-C(=O)\right]\!\!- \quad (5)$$

In formulae (4) and (5), $Ar^{13}$ and $Ar^{14}$ each represents an arylene group which may have a substituent, and $Ar^{15}$ represents a divalent group having an aromatic ring which may have a substituent. Specific examples of $Ar^{15}$ include an arylene group which may have a substituent and a divalent group represented by the following formula (A). In formula (A), $Ar^{16}$ and $Ar^{17}$ each represents an arylene group which may have a substituent. Particularly, in formula (A), $Ar^{16}$ and $Ar^{17}$ each is preferably a phenylene group which may have a substituent.

$$—Ar^{16}—O—Ar^{17}— \quad (A)$$

The substituent which $Ar^{13}$ to $Ar^{17}$ may have includes an alkyl substituent having a carbon number of 1 to 10 and an alkoxy substituent having a carbon number of 1 to 10, which may have a substituent. Q represents a single bond or $—CR^{16}R^{17}—$, and $R^{16}$ and $R^{17}$ each independently represents a hydrogen atom, an alkyl group, an aryl group or a linked alicyclic structure.

In formulae (4) and (5), $—O—Ar^{13}-Q-Ar^{14}—O—$ represents a partial structure of the dihydroxyaryl component. Examples of the dihydroxyaryl component forming these structures include a bisphenol residue and a biphenol residue, and specific examples thereof include bisphenol components such as bis-(4-hydroxy-3,5-dimethylphenyl)methane, bis-(4-hydroxyphenyl)methane, bis-(4-hydroxy-3-methylphenyl)methane, 1,1-bis-(4-hydroxyphenyl)ethane, 1,1-bis-(4-hydroxyphenyl)propane, 2,2-bis-(4-hydroxyphenyl)propane, 2,2-bis-(4-hydroxy-3-methylphenyl)propane, 2,2-bis-(4-hydroxyphenyl)butane, 2,2-bis-(4-hydroxyphenyl)pentane, 2,2-bis-(4-hydroxyphenyl)-3-methylbutane, 2,2-bis-(4-hydroxyphenyl)hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(3-phenyl-4-hydroxyphenyl)methane, 1,1-bis-(3-phenyl-4-hydroxyphenyl)ethane, 1,1-bis-(3-phenyl-4-hydroxyphenyl)propane, 2,2-bis-(3-phenyl-4-hydroxyphenyl)propane, 1,1-bis-(4-hydroxy-3-methylphenyl)ethane, 2,2-bis-(4-hydroxy-3-methylphenyl)propane, 2,2-bis-(4-hydroxy-3-ethylphenyl)propane, 2,2-bis-(4-hydroxy-3-isopropylphenyl)propane, 2,2-bis-(4-hydroxy-3-sec-butylphenyl)propane, 1,1-bis-(4-hydroxy-3,5-dimethylphenyl)ethane, 2,2-bis-(4-hydroxy-3,5-dimethylphenyl)propane, 1,1-bis(4-hydroxy-3,5-dimethylphenyl)cyclohexane, 1,1-bis-(4-hydroxy-3,6-dimethylphenyl)ethane, bis-(4-hydroxy-2,3,5-trimethylphenyl)methane, 1,1-bis-(4-hydroxy-2,3,5-trimethylphenyl)ethane, 2,2-bis-(4-hydroxy-2,3,5-trimethylphenyl)propane, bis-(4-hydroxy-2,3,5-trimethylphenyl)phenylmethane, 1,1-bis-(4-hydroxy-2,3,5-trimethylphenyl)phenylethane, 1,1-bis-(4-hydroxy-2,3,5-trimethylphenyl)cyclohexane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl)diphenylmethane, bis-(4-hydroxyphenyl)dibenzoylmethane, 4,4'-[1,4-phenylenebis(1-methylethylidene)]bis-[phenyl], 4,4'-[1,4-phenylenebismethylene]bis-[phenyl], 4,4'-[1,4-phenylenebis(1-methylethylidene)]bis-[2,6-dimethylphenol], 4,4'-[1,4-phenylenebismethylene]bis-[2,6-dimethylphenol], 4,4'-[1,4-phenylenebismethylene]bis-[2,3,6-trimethylphenol 4,4'-(1,4-phenylenebis(1-methylethylidene)]bis-[2,3,6-trimethylphenol], 4,4'-[1,3-phenylenebis(1-methylethylidene)]bis-[2,3,6-trimethylphenol], 4,4'-dihydroxydiphenylether, stearyl 4,4-bis(4-hydroxyphenyl)valerate, 4,4'-dihydroxydiphenylsulfone, 4,4'-dihydroxydiphenylsulfide, 3,3',5,5'-tetramethyl-4,4'-dihydroxydiphenylether, 3,3',5,5'-tetramethyl-4,4'-dihydroxydiphenylsulfone, 3,3',5,5'-tetramethyl-4,4'-dihydroxydiphenylsulfide, phenolphthalein, 4,4'-[1,4-phenylenebis(1-methylvinylidene)]bisphenol, 4,4'-[1,4-phenylenebis(1-methylvinylidene)]bis[2-methylphenol], (2-hydroxyphenyl)(4-hydroxyphenyl)methane, (2-hydroxy-5-methylphenyl)(4-hydroxy-3-methylphenyl)methane, 1,1-(2-hydroxyphenyl)(4-hydroxyphenyl)ethane, 2,2-(2-hydroxyphenyl)(4-hydroxyphenyl)propane and 1,1-(2-hydroxyphenyl)(4-hydroxyphenyl)propane, and biphenol components such as 4,4'-biphenol, 2,4'-biphenol, 3,3'-dimethyl-4,4'-dihydroxy-1,1'-biphenyl, 3,3'-dimethyl-2,4'-dihydroxy-1,1'-biphenyl, 3,3'-di-(tert-butyl)-4,4'-dihydroxy-1,1'-biphenyl, 3,3',5,5'-tetramethyl-4,4'-dihydroxy-1,1'-biphenyl, 3,3',5,5'-tetra-(tert-butyl)-4,4'-dihydroxy-1,1'-biphenyl and 2,2',3,3',5,5'-hexamethyl-4,4'-dihydroxy-1,1'-biphenyl.

Among these compounds, preferred are bisphenol components such as bis-(4-hydroxy-3,5-dimethylphenyl)methane, bis-(4-hydroxyphenyl)methane, bis-(4-hydroxy-3-methylphenyl)methane, 2,2-bis-(4-hydroxy-3-methylphenyl)propane, 1,1-bis-(4-hydroxyphenyl)ethane, 2,2-bis-(4-hydroxyphenyl)propane, 2-hydroxyphenyl(4-hydroxyphenyl)methane and 2,2-(2-hydroxyphenyl)(4-hydroxyphenyl)propane.

In formula (5), the partial structure represented by $—C(=O)—Ar^{15}—C(=O)—$ is a residue derived from a dicarboxylic acid. Specific example of the dicarboxylic acid residue include a phthalic acid residue, an isophthalic acid residue, a terephthalic acid residue, a toluene-2,5-dicarboxylic acid residue, a p-xylene-2,5-dicarboxylic acid residue, a naphthalene-1,4-dicarboxylic acid residue, a naphthalene-2,3-dicarboxylic acid residue, a naphthalene-2,6-dicarboxylic acid residue, a biphenyl-2,2'-dicarboxylic acid residue, a biphenyl-4,4'-dicarboxylic acid residue, a diphenylether-2,2'-dicarboxylic acid residue, a diphenylether-2,3'-dicarboxylic acid residue, a diphenylether-2,4'-dicarboxylic acid residue, a diphenylether-3,3'-dicarboxylic acid residue, a diphenylether-3,4'-dicarboxylic acid residue and a diphenylether-4,4'-dicarboxylic acid residue.

Among these, preferred are a phthalic acid residue, an isophthalic acid residue, a terephthalic acid residue, a naphthalene-1,4-dicarboxylic acid residue, a naphthalene-2,6-dicarboxylic acid residue, a biphenyl-2,2'-dicarboxylic acid residue, a biphenyl-4,4'-dicarboxylic acid residue, a diphenylether-2,2'-dicarboxylic acid residue, a diphenylether-2,4'-dicarboxylic acid residue and a diphenylether-4,4'-dicarboxylic acid residue.

In particular, an isophthalic acid residue, a terephthalic acid residue and a diphenylether-4,4'-dicarboxylic acid residue are more preferred.

Also, a plurality of kinds of these dicarboxylic acid residues may be used in combination. In the case of using a plurality of kinds of dicarboxylic acid residues, it is preferred that the percentage abundance of the dicarboxylic acid residue having a structure represented by formula (A) exceeds 70%. The percentage abundance of the dicarboxylic acid residue having a structure represented by formula (A) more preferably exceeds 80%, and the percentage abundance of the dicarboxylic acid residue having a structure represented by formula (A) still more preferably exceeds 90%.

If the molecular weight of the binder resin is too small, the mechanical strength is insufficient, whereas if the molecular weight is excessively large, the viscosity of the coating solution for forming the photosensitive layer becomes too high and the productivity disadvantageously decreases. Therefore, in the case of a polycarbonate resin and a polyarylate resin, the molecular weight is, in terms of the viscosity average molecular weight, 10,000 or more, preferably 20,000 or more, and is 100,000 or less, preferably 70,000 or less.

In the case of the single layer-type photosensitive layer, the charge generating substance is dispersed in the charge transport medium having a compounding ratio as in the above-described charge transport layer. The amount of the charge generating substance used is preferably from 0.5 to 50 wt %, more preferably from 1 to 20 wt %, based on the binder resin. The thickness of the photosensitive layer is generally from 5 to 50 μm, preferably from 10 to 45 μm. In this case, in order to enhance the film-forming property, coatability, contamination resistance, gas resistance and the like, known additives such as plasticizer, electron withdrawing compound, leveling agent and antioxidant may be contained in the photosensitive layer.

For the purpose of preventing electrical or mechanical deterioration, a protective layer may be provided on the photosensitive layer. Also, for the purpose of reducing the frictional resistance or abrasion on the photoreceptor surface, the surface layer may contain a fluorine-based resin, a silicone resin or the like or may contain a particle comprising this resin or an inorganic compound particle.

Layer Forming Method

The photosensitive layer of the electrophotographic photoreceptor of the present invention can be produced by dissolving or dispersing a compound represented by formula (1) and/or an azo compound together with a binder in an appropriate solvent in a usual manner, further appropriately adding, if desired, a charge generating substance, a sensitizing dye, an electron withdrawing compound, another charge transport substance and known additives such as plasticizer and pigment, and then coating and drying the obtained coating solution on an electroconductive substrate.

In the case of a photosensitive layer consisting of two layers of charge generating layer and charge transport layer, the above-described coating solution is coated on the charge generating layer, or the charge generating layer is formed on the charge transport layer obtained by coating the above-described coating solution, whereby the photosensitive layer can be produced.

Examples of the solvent or dispersion medium used for the production of the coating solution for forming each layer constituting the photoreceptor include alcohols such as methanol, ethanol, propanol and 2-methoxyethanol; ethers such as tetrahydrofuran, 1,4-dioxane and dimethoxyethane; esters such as methyl formate and ethyl acetate; ketones such as acetone, methyl ethyl ketone and cyclohexanone; aromatic hydrocarbons such as benzene, toluene and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane and trichloroethylene; nitrogen containing compounds such as n-butylamine, isopropanolamine, diethylamine, triethanolamine, ethylenediamine and triethylenediamine; and aprotic polar solvents such as acetonitrile, N-methylpyrrolidone, N,N-dimethylformamide and dimethylsulfoxide. One of these solvents is used alone or two or more species thereof are used in combination.

Examples of the method for forming the photosensitive layer by coating include a spray coating method, a spiral coating method, a ring coating method and a dip coating method.

The spray coating method includes air spraying, airless spraying, electrostatic air spraying, electrostatic airless spraying, rotation-atomization type electrostatic spraying, hot spraying, hot airless spraying and the like. Considering fine particle formation, deposition efficiency or the like for obtaining a uniform film thickness, when the photosensitive layer is formed using the rotation-atomization type electrostatic spraying by employing the conveying method disclosed in Domestic Re-publication of PCT Application 1-805198, that is, by continuously conveying a cylindrical work in the axial direction without causing a gap while rotating it, an electrophotographic photoreceptor excellent in the uniformity of the film thickness can be obtained comprehensively with high deposition efficiency.

The spiral coating method includes a method using a pouring-coating or curtain-coating machine disclosed in JP-A-52-119651, a method of causing a coating material to continuously fly in streaks from micro-openings disclosed in JP-A-1-231966, a method using a multi-nozzle body disclosed in JP-A-3-193161, and the like.

In the dip coating method, the coating solution or liquid dispersion is produced to have an entire solid content concentration of preferably from 10 to 50 wt %, more preferably from 15 to 35 wt %, and a viscosity of preferably from 50 to 700 mPa·s, more preferably from 100 to 500 mPa·s, for the single layer-type photosensitive layer or the charge transport layer of the lamination-type photosensitive layer, and is produced to have an entire solid content concentration of preferably 15 wt % or less, more preferably from 1 to 10 wt %, and a viscosity of preferably 0.1 to 10 mPa·s for the charge generating layer of the lamination-type photosensitive layer.

After the coating film is formed, the coating film is dried and at this time, the drying temperature and time are preferably adjusted to achieve necessary and satisfactory drying. If the drying temperature is too high, this causes mingling of an air bubble in the photosensitive layer, whereas if it is excessively low, the drying takes much time and the residual solvent amount is increased to adversely affect the electric properties. Therefore, the drying temperature is usually from 100 to 250° C., preferably from 110 to 170° C., more preferably from 120 to 140° C. As for the drying method, a hot air drier, a steam drier, an infrared drier, a far infrared drier and the like may be used.

<Image Forming Apparatus>

The embodiment of the image forming apparatus using the electrophotographic photoreceptor of the present invention is described below by referring to FIG. 1 showing the main part construction of the apparatus. However, the embodiment is not limited to those described below and may be arbitrarily modified without departing from the purport of the present invention.

As shown in FIG. 1, the image forming apparatus is constructed to comprise an electrophotographic photoreceptor 1, a charging device 2, an exposure device 3 and a developing device 4, and furthermore, a transfer device 5, a cleaning device 6 and a fixing device 7 are provided, if desired.

The electrophotographic photoreceptor 1 is not particularly limited as long as it is the above-described electrophotographic photoreceptor of the present invention, but in FIG. 1, as one example thereof, a drum-like photoreceptor comprising a cylindrical electroconductive support having formed on the surface thereof the above-described photosensitive layer is shown. Along the outer peripheral surface of the electrophotographic photoreceptor 1, a charging device 2, a exposure device 3, a developing device 4, a transfer charger 5 and a cleaning device 6 are disposed.

The charging device 2 is disposed to charge the electrophotographic photoreceptor 1 and uniformly charges the surface of the electrophotographic photoreceptor 1 to a predetermined potential. In FIG. 1, as one example of the charging device 2, a roller-type charging device (charging roller) is shown but other than this, for example, a corona charging device such as corotron and scorotron, or a contact-type charging device such as charging brush, is often used.

Incidentally, the electrophotographic photoreceptor 1 and the charging device 2 are designed in many cases as a cartridge comprising both members (hereinafter, sometimes referred to as a "photoreceptor cartridge") and being removable from the main body of the image forming apparatus. For example, when the electrophotographic photoreceptor 1 or the charging device 2 is deteriorated, the photoreceptor cartridge can be removed from the main body of the image forming apparatus and another new photoreceptor cartridge can be mounted in the main body of the image forming apparatus. Furthermore, the toner described later is also stored in a toner cartridge in many cases, and the cartridge is designed to be removable from the main body of the image forming apparatus, so that when there is no more toner in the toner cartridge used, another new toner cartridge can be mounted. In some cases, a cartridge comprising all of the electrophotographic photoreceptor 1, the charging device 2 and the toner is used.

The exposure device 3 is not particularly limited in its type as long as the electrophotographic photoreceptor 1 can be exposed and an electrostatic latent image can be formed on the photosensitive surface of the electrophotographic photoreceptor 1. Specific examples thereof include a halogen lamp, a fluorescent lamp, a laser such as semiconductor laser and He—Ne laser, and LED. The exposure may also be performed by a photoreceptor inside exposure system. The light for the exposure may be arbitrary light, but the exposure is preferably performed with short-wavelength monochromatic light or the like at a wavelength of 380 to 500 nm, more preferably with monochromatic light at a wavelength of 380 to 430 nm.

The developing device 4 is not particularly limited in its type, and an arbitrary device employing, for example, a dry developing system such as cascade development, one-component conducting toner development and two-component magnetic brush development, or a wet developing system may be used. In FIG. 1, the developing device 4 comprises a developing tank 41, an agitator 42, a feed roller 43, a developing roller 44 and a regulating member 45 and is constructed to store a toner T in the developing tank 41. Also, a refilling device (not shown) for refilling the toner T may be added to the developing device 4, if desired. This refilling device is constructed so that the toner T can be refilled from a container such as bottle and cartridge.

The feed roller 43 is formed of an electroconductive sponge or the like. The developing roller 44 comprises a metal roll such as iron, stainless steel, aluminum and nickel, or a resin roll obtained by covering such a metal roll with a silicone resin, a urethane resin, a fluororesin or the like. The surface of this developing roller 44 may be subjected to smoothening or roughening, if desired.

The developing roller 44 is disposed between the electrophotographic photoreceptor 1 and the feed roller 43 and abutted on each of the electrophotographic photoreceptor 1 and the feed roller 43. The feed roller 43 and the developing roller 44 are rotated by a rotation driving mechanism (not shown). The feed roller 43 carries the toner T stored and feed it to the developing roller 44. The developing roller 44 carries the toner T fed by the feed roller 43 and brings it into contact with the surface of the electrophotographic photoreceptor 1.

The regulating member 45 is formed from, for example, a resin blade such as silicone resin and urethane resin, a metal blade such as stainless steel, aluminum, copper, brass and phosphor bronze, or a blade obtained by covering such a metal blade with a resin. This regulating member 45 is abutted on the developing roller 44 and pressed to the developing roller 44 side by a spring or the like under a predetermined force (the blade linear pressure is generally from 5 to 500 g/cm). If desired, the regulating member 45 may be made to have a function of causing frictional charging with the toner T and thereby imparting charging to the toner T.

Each agitator 42 is rotated by a rotation driving mechanism and while stirring the toner T, conveys the toner T to the supply roller 43 side. A plurality of agitators 42 differing in the blade shape, size or the like may be provided.

The toner T may be an arbitrary type and in addition to the powder toner, a polymerized toner or the like obtained using a suspension polymerization method or an emulsion polymerization method may be used. Particularly, in the case of using a polymerized toner, a toner having a small particle diameter of approximately from 4 to 8 μm is preferred. As for the shape of the toner particle, various shapes from a nearly spherical shape to a non-spherical potato-like shape may be used. The polymerized toner is excellent in the charging uniformity and transferability and is suitably used for the elevation of image quality.

The transfer device 5 is not particularly limited in its type, and a device employing an arbitrary system, for example, an electrostatic transfer method such as corona transfer, roller transfer and belt transfer, a pressure transfer method or an adhesive transfer method, may be used. Here, the transfer device 5 is composed of a transfer charger, transfer roller, transfer belt or the like disposed to oppose the electrophotographic photoreceptor 1. This transfer device 5 applies a predetermined voltage value (transfer voltage) with a polarity opposite to the charging potential of the toner T and transfers the toner image formed on the electrophotographic photoreceptor 1 onto recording paper (sheet, medium) P.

The cleaning device 6 is not particularly limited, and an arbitrary cleaning device such as brush cleaner, magnetic brush cleaner, electrostatic brush cleaner, magnetic roller cleaner and blade cleaner may be used. The cleaning device 6 scrapes off the residual toner adhering to the photoreceptor 1 by a cleaning member and recovers the residual toner. However, in the case where the toner slightly or scarcely remains on the photoreceptor surface, the cleaning device 6 is not indispensable.

The fixing device 7 is composed of an upper fixing member (pressure roller) 71 and a lower fixing member (fixing roller) 72, and a heating device 73 is provided inside the fixing member 71 or 72. Incidentally, FIG. 1 shows a case where the heating device 73 is provided inside the upper fixing member 71. As for upper and lower respective fixing members 71 and 72, a known heat fixing member, for example, a fixing roller obtained by covering a metal blank tube such as stainless steel or aluminum with a silicon rubber, a fixing roll obtained by further covering the roll with Teflon (registered trademark) resin, or a fixing sheet, may be used. Furthermore, the fixing members 71 and 72 may be constructed each to supply a releasing agent such as silicone oil for enhancing the releasability or may be constructed to enforcedly apply a pressure to each other by using a spring or the like.

The toner transferred onto the recording paper P is heated to a melted sate on passing between the upper fixing member 71 and the lower fixing member 72 each heated to a predetermined temperature and after passing, the toner is cooled, whereby the toner is fixed on the recording paper P.

The fixing device is also not particularly limited in its type, and the fixing device used here or a fixing device in an arbitrary system, such as heat roller fixing, flash fixing, oven fixing and pressure fixing, may be provided.

In the thus-constructed electrophotographic apparatus, the image recording is performed as follows. First, the photoreceptor 1 surface (photosensitive surface) is electrically charged to a predetermined potential (for example, −600 V) by the charging device 2. At this time, the surface may be electrically charged by a CD voltage or by superposing an AC voltage on a DC voltage.

Subsequently, the electrically charged photosensitive surface of the photoreceptor 1 is exposed by the exposure device 3 according to the image to be recorded and an electrostatic latent image is formed on the photosensitive surface. The development of this electrostatic latent image formed on the photosensitive surface of the photoreceptor 1 is performed by the developing device 4.

In the developing device 4, the toner T fed by the feed roller 43 is formed into a thin layer by the regulating member (developing blade) 45, frictionally charged to a predetermined polarity (here, the same polarity as the charging potential of the photoreceptor 1, that is, negative polarity), conveyed while being carried on the developing roller 44, and brought into contact with the photoreceptor 1 surface.

When the electrically charged toner T carried on the developing roller 44 comes into contact with the photoreceptor 1 surface, a toner image corresponding to the electrostatic latent image is formed on the photosensitive surface of the photoreceptor 1. This toner image is then transferred onto the recording paper P by the transfer device 5. Thereafter, the toner not transferred but remaining on the photosensitive surface of the photoreceptor 1 is removed by the cleaning device 6.

After transferring the toner image onto the recording paper P, the paper is passed through the fixing device 7 to heat-fix the toner image on the recording paper P, whereby a final image is obtained.

In addition to the above-described construction, the image forming apparatus may have a construction where, for example, a erasing step can be performed. The erasing step is a step of exposing the electrophotographic photoreceptor and thereby erasing the electrophotographic photoreceptor. As for the destaticizing device, a fluorescent lamp, LED or the like is used. Also, the light used in the erasing step is in many cases light having an intensity of, in terms of the exposure energy, 3 times or more that of the exposure light.

The image forming apparatus may also have a modified construction, for example, may be constructed to allow for steps such as pre-exposure step and auxiliary charging step, may be constructed to perform offset printing, or may be constructed in a full-color tandem system using a plurality of kinds of toners.

EXAMPLES

The present invention is described in greater detail below by referring to Examples and Comparative Examples but as long as the purpose of the present invention is observed, the present invention is not limited to the following Examples. In the following, the "parts" denotes "parts by weight". Incidentally, the viscosity average molecular weight of the resin used for the charge transport layer was calculated as follows. The resin was dissolved in dichloromethane to prepare a solution having a concentration C of 6.00 g/L. Using a Ubbelohde-type capillary viscometer with the flow time to of the solvent (dichloromethane) being 136.16 seconds, the flow time t of the sample solution was measured in a constant-temperature water bath set at 20.0° C. The viscosity average molecular weight was calculated according to the following formulae:

$$a=0.438\times\eta_{sp}+1 \quad \eta_{sp}=t/t_0-1$$

$$b=100\times\eta_{sp}/C \quad C=6.00\ (g/L)$$

$$\eta=b/a$$

$$Mv=3207\times\eta^{1.205}$$

Example 1

A 75 μm-thick polyester film having vapor-deposited thereon aluminum was used as the support, and the following coating solution for charge generating layer was coated thereon by a wire bar to have a dry film thickness of 0.4 μm and dried to form a charge generating layer. On this layer, the following coating solution for charge transport layer was coated by an applicator and dried at room temperature for 30 minutes and then at 125° C. for 20 minutes to produce Photoreceptor A having a 25 μm-thick charge transport layer. The coating solution for charge transport layer used here was coated on a quartz glass to have a dry film thickness of 25 μm and dried, and the transmittance of the obtained sample for light at 427 nm was measured using a spectrophotometer UV1650PC manufactured by Shimadzu Corporation with the background being an equivalent quartz glass and found to be 99.9%.

Coating Solution for Charge Generating Layer

30 Parts of 1,2-dimethoxyethane was added to 1.5 parts of the compound represented by the following formula (6), and this mixture was ground by a sand grind mill for 8 hours, thereby performing a pulverization and dispersion treatment. The obtained dispersion was mixed with a binder solution prepared by dissolving 0.75 parts of polyvinylbutyral ("Denkabutyral" #6000C, trade name, produced by Denki Kagaku Kogyo K.K.) and 0.75 parts of phenoxy resin (PKHH, a product of Union Carbide Corp.) in 28.5 parts of 1,2-dimethoxyethane, and further mixed with 13.5 parts of a mixed solution containing 1,2-dimethoxyethane and 4-methoxy-4-methyl-2-pentanone at an arbitrary ratio to prepare a coating solution for charge generating layer having a solid content concentration of 4.0 wt %.

(6)

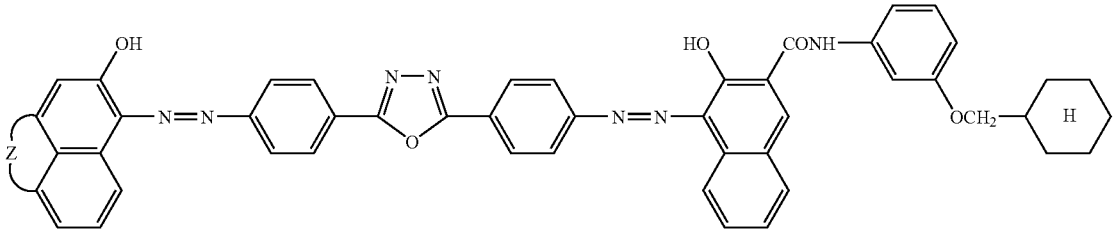

(wherein Z represents

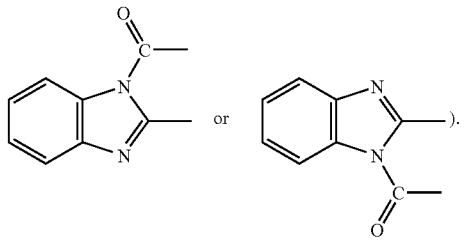

).

Coating Solution for Charge Transport Layer

70 Parts of the compound represented by the following formula (7) and 100 parts of the polycarbonate resin represented by the following formula (8) (m:n=51:49, viscosity average molecular weight: 30,000) were dissolved in 480 parts of tetrahydrofuran and 120 parts of toluene to prepare a coating solution for charge transport layer.

(7)

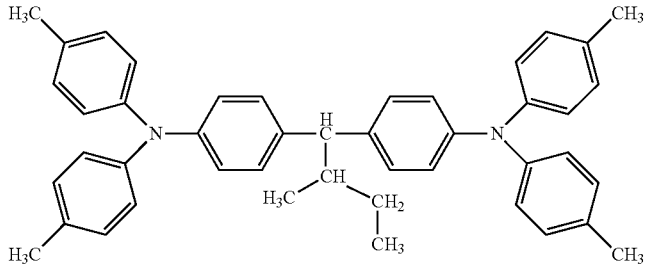

(8)

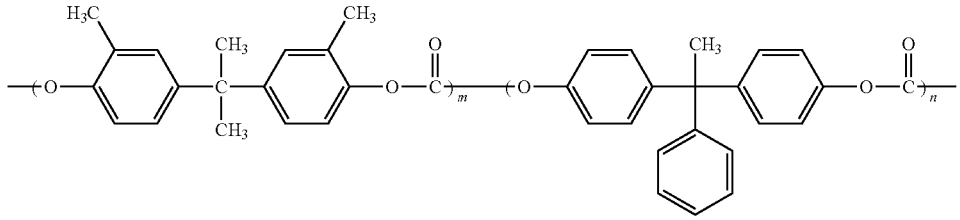

m:n = 51:49

Example 2

Photoreceptor B was produced in the same manner as in Example 1 except that in the coating solution for charge transport layer used Example 1, the amount of the compound represented by formula (7) was changed to 90 parts. The transmittance of the film for light at 427 nm was measured in the same manner as in Example 1 by using the coating solution for charge transport layer used here and found to be 99.9%.

Example 3

Photoreceptor C was produced in the same manner as in Example 1 except that in the coating solution for charge transport layer used Example 1, the amount of the compound represented by formula (7) was changed to 50 parts. The transmittance of the film for light at 427 nm was measured in the same manner as in Example 1 by using the coating solution for charge transport layer used here and found to be 99.9%.

Example 4

Photoreceptor D was produced thoroughly in the same manner as in Example 1 except that in Example 1, the compound represented by the following formula (9) was used in place of the compound represented by formula (7). The transmittance of the charge transport layer for light at 427 nm was measured in the same manner as in Example 1 by using the coating solution for charge transport layer used here and found to be 99.9%.

(9)

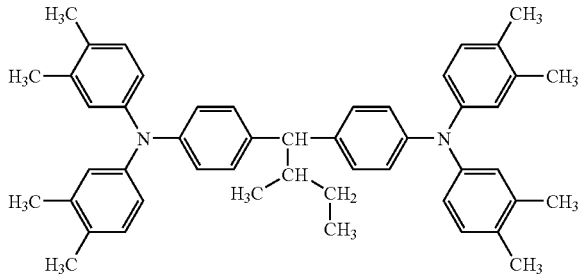

Comparative Example 1

Photoreceptor E was produced thoroughly in the same manner as in Example 1 except that in Example 1, a mixture containing 35 parts of the charge transport material of the following formula (10) and 35 parts of the charge transport material of formula (11) was used in place of the compound represented by formula (7). The transmittance of the film for light at 427 nm was measured in the same manner as in Example 1 by using the coating solution for charge transport layer used here and found to be 99.0%.

(10)

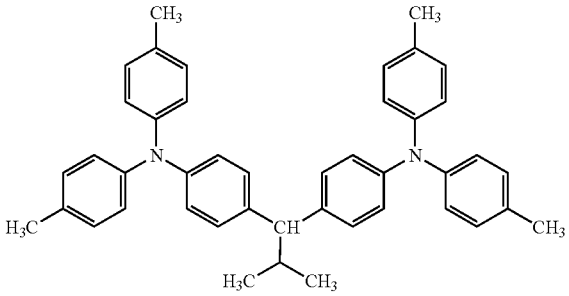

-continued (11)

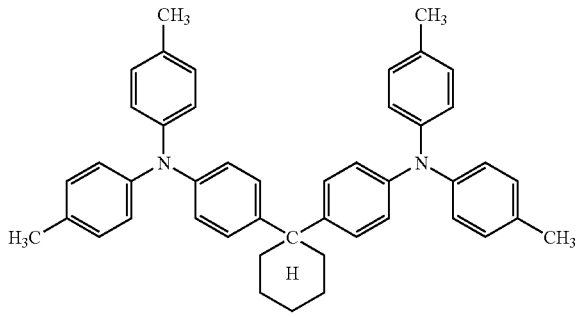

Comparative Example 2

Photoreceptor F was produced thoroughly in the same manner as in Example 1 except that in Example 1, the compound of the following formula (12) was used in place of the compound represented by formula (6) and a mixture containing 35 parts of the substance of formula (10) and 35 parts of the substance of formula (11) was used in place of the compound represented by formula (7). The transmittance of the film for light at 427 nm was measured in the same manner as in Example 1 by using the coating solution for charge transport layer used here and found to be 99.0%.

(12)

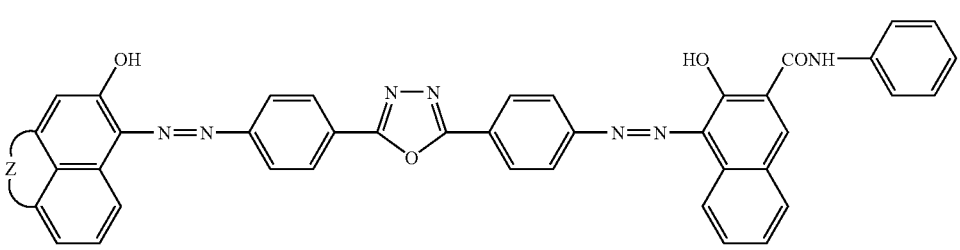

(wherein Z is

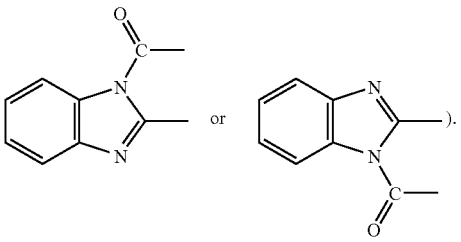

Comparative Example 3

Photoreceptor G was produced thoroughly in the same manner as in Example 3 except that in Example 3, the compound of formula (10) was used in place of the compound represented by formula (7). The transmittance of the film for light at 427 nm was measured in the same manner as in Example 1 by using the coating solution for charge transport layer used here and found to be 99.0%.

Photoreceptors A to F obtained each was mounted in a photoreceptor characteristic evaluation apparatus (manufactured by Mitsubishi Chemical Corp.), and the electric properties were evaluated by a cycle of charging, exposure, potential measurement and erasing.

Each photoreceptor was laminated on an aluminum-made drum having an outer diameter of 80 mm, the aluminum-made drum and the aluminum-deposited layer of the photoreceptor were electrically conducted, and the drum was rotated at a constant rotation speed with a rotation number of 30 rpm. The photoreceptor was electrically charged in an environment of a temperature of 25° C. and a humidity of 50% to give an initial surface potential of −700 V and exposed using a halogen lamp of which light was converted into monochromatic light of 427 nm through an interference filter. The exposure dose (hereinafter sometimes referred to as "sensitivity") giving a surface potential of −350 V and the surface potential (hereinafter referred to as "VL") when exposed with a light quantity of 1.11 μJ/cm$^2$ were determined. The time from exposure to potential measurement was set to 389 msec. White light of 75 lux was used for the erasing light, and the exposure width was set to 5 mm. The residual potential (hereinafter referred to as "Vr") after the irradiation of erasing light was measured.

The sensitivity is an exposure dose necessary for the surface potential to become ½ the initial potential and as the numerical value is smaller, the sensitivity is higher. VL and Vr are a potential after exposure, and a smaller value is more excellent as the electric property. The results are shown in Table 2 below.

TABLE 2

| | Photoreceptor | Sensitivity (μJ/cm$^2$) | VL (−V) | Vr (−V) |
|---|---|---|---|---|
| Example 1 | Photoreceptor A | 0.29 | 11 | 6 |
| Example 2 | Photoreceptor B | 0.27 | 10 | 5 |
| Example 3 | Photoreceptor C | 0.33 | 17 | 9 |
| Example 4 | Photoreceptor D | 0.22 | 11 | 6 |
| Comparative Example 1 | Photoreceptor E | 0.31 | 25 | 12 |
| Comparative Example 2 | Photoreceptor F | 0.45 | 98 | 14 |

The photoreceptors of Examples 1 to 4 were good in the balance of sensitivity, VL and Vr as compared with photoreceptors of Comparative Examples 1 and 2 and revealed to be a suitable photoreceptor.

Subsequently, light of a white fluorescent lamp (Neolumisuper FL20SS•W/18, manufactured by Mitsubishi Osram Corp.) adjusted to give a light intensity of 2,000 lux on the photoreceptor surface was irradiated on Photoreceptors C and G for 10 minutes and after standing in a dark place for 10 minutes, the same measurements were performed.

The amount of change in the electric properties of the initial surface potential and VL between before and after irradiation of the white fluorescent lamp are shown in Table 3. A smaller amount of change reveals that the photoreceptor causes less characteristic change even when exposed to strong light and the characteristics under strong light exposure as an electric property of the photoreceptor is more excellent.

TABLE 3

| | Photoreceptor | Change of Initial Surface Potential (V) | Amount of Change in VL (V) |
|---|---|---|---|
| Example 3 | Photoreceptor C | −15 | 32 |
| Comparative Example 3 | Photoreceptor G | −15 | 70 |

The photoreceptor of Example 3 exhibited a small amount of change in the potential even after exposure to strong light as compared with the photoreceptor of Comparative Example 3 and was revealed to have excellent strong-light resistance performance.

As verified above, the photoreceptor having a photosensitive layer containing the compound represented by formula (7) is good in the balance of electric properties as represented by sensitivity, VL and Vr and moreover, is hardly deteriorated even when exposed to strong light.

The coating solutions for charge transport layer prepared in Examples 1 to 3 and Comparative Example 3 were stored in an environment of 25° C. for 90 days, and the state of each solution was observed. The results are shown in Table 4.

TABLE 4

| | Coating Solution for Charge Transport Layer | State after Storage for 90 Days |
|---|---|---|
| Example 1 | A | transparent and no precipitation |
| Example 2 | B | transparent and no precipitation |
| Example 3 | C | transparent and no precipitation |
| Comparative Example 3 | G | many crystals were precipitated in the solution |

In this way, the coating solution using the compound represented by formula (7) exhibits excellent storage stability even when the amount in terms of parts of the compound represented by formula (7) used is increased.

Example 5

Photoreceptor A2 was produced in the same manner as in Example 1 except that a coating solution for charge generating layer prepared by the following method was used in place of the coating solution for charge generating layer used in Example 1.

Coating Solution for Charge Generating Layer 0.4 Parts of the compound represented by formula (6), 27 parts of 1,2-dimethoxyethane and 3 parts of 4-methoxy-4-methyl-2-pentanone were mixed, and this mixture was ground by a sand grind mill for 4 hours, thereby performing a pulverization and dispersion treatment to prepare a pigment liquid dispersion. This pigment liquid dispersion was mixed with 0.2 parts of polyvinylbutyral ("Denkabutyral" #6000C, trade name, produced by Denki Kagaku Kogyo K.K.) and further mixed and stirred for 1 hour to prepare a coating solution for charge generating layer having a solid content concentration of 2.0 wt %.

Example 6

Photoreceptor B2 was obtained in the same manner as in Example 5 except that the charge generating substance of the following formula (IT) synthesized by the method described in JP-A-59-113446 was used in place of the compound represented by formula (6) used in Example 5.

(1T)

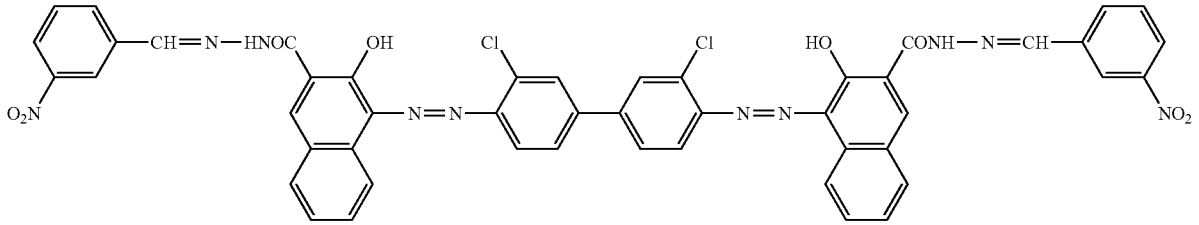

Example 7

Photoreceptor C2 was obtained in the same manner as in Example 5 except that the charge generating substance of the following formula (2T) synthesized by the method described in JP-A-64-80964 was used in place of the compound represented by formula (6) used in Example 5.

(2T)

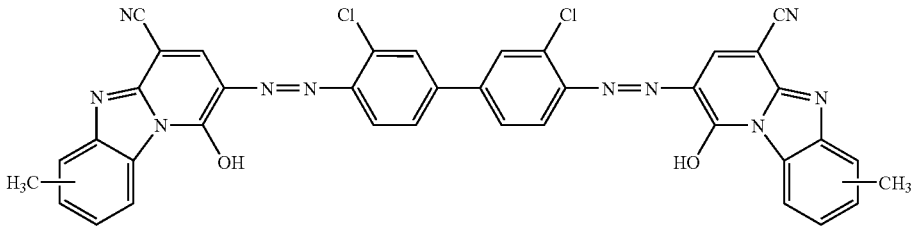

Example 8

Photoreceptor D2 was obtained in the same manner as in Example 5 except that the charge generating substance of the following formula (3T) synthesized by the method described in JP-A-59-139045 was used in place of the compound represented by formula (6) used in Example 5.

(3T)

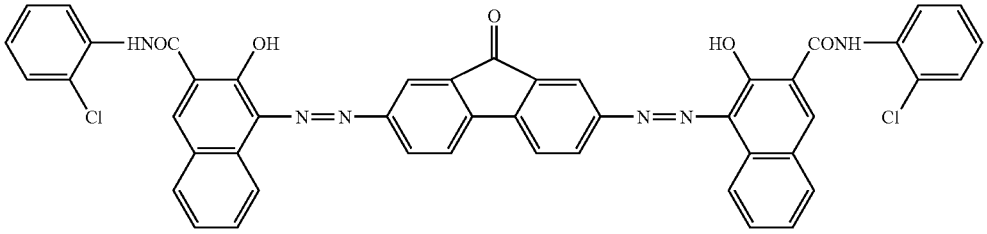

Example 9

Photoreceptor E2 was obtained in the same manner as in Example 5 except that the charge generating substance of the following formula (4T) synthesized by the method described in JP-A-5-32905 was used in place of the compound represented by formula (6) used in Example 5.

(4T)

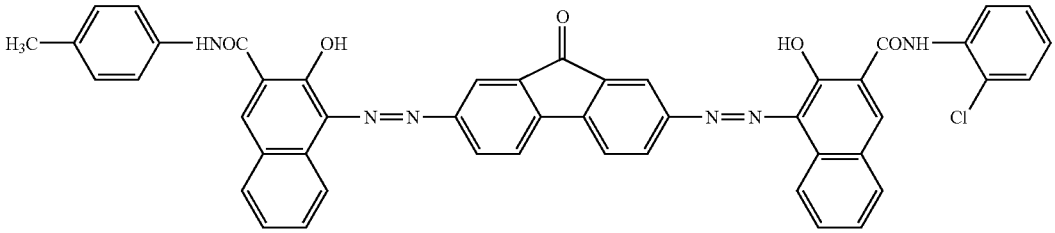

Example 10

Photoreceptor F2 was obtained in the same manner as in Example 5 except that the charge generating substance of the following formula (5T) synthesized by the method described in JP-A-3-119362 was used in place of the compound represented by formula (6) used in Example 5.

(5T)

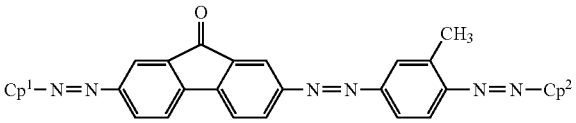

In formula (5T), $Cp^1$ and $Cp^2$ may be the same or different and each represents

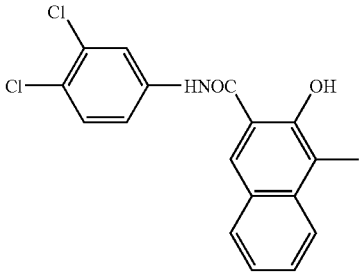

or

-continued

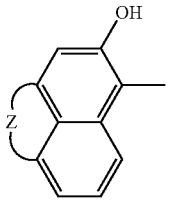

wherein Z represents

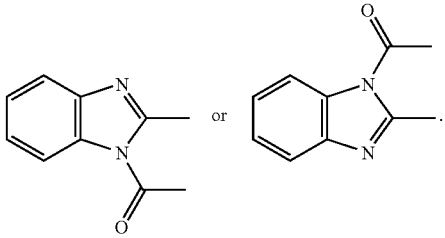

Example 11

Photoreceptor G2 was obtained in the same manner as in Example 5 except that the charge generating substance of the following formula (6T) synthesized by the method described in JP-A-57-195767 was used in place of the compound represented by formula (6) used in Example 5.

(6T)

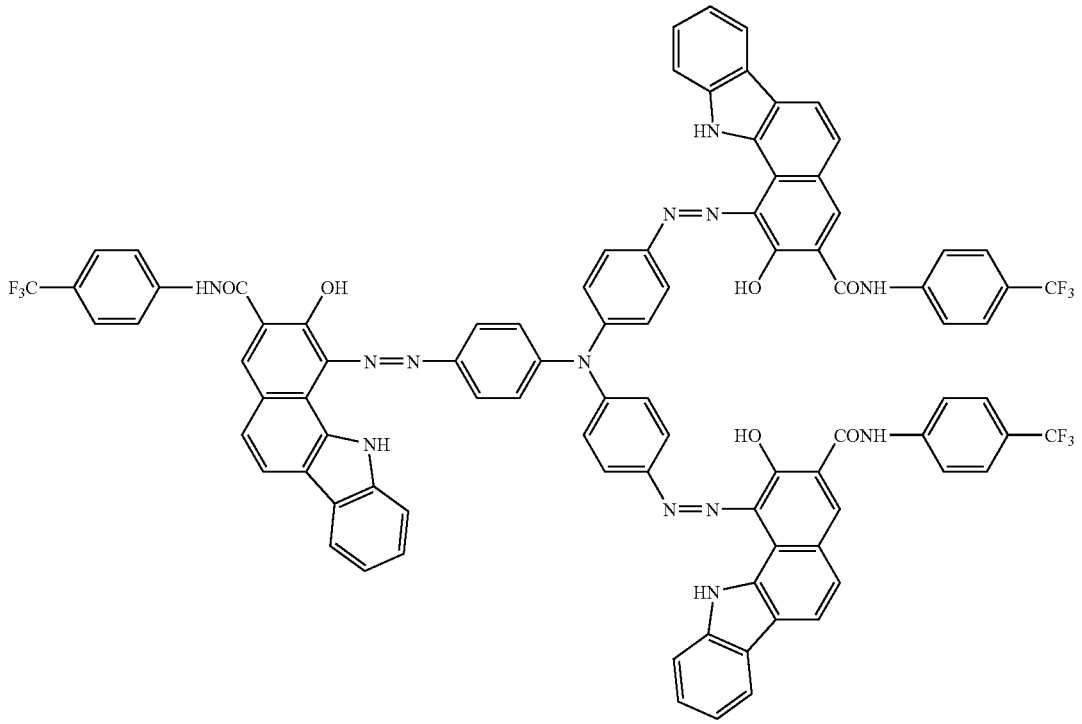

Example 12

Photoreceptor H2 was obtained in the same manner as in Example 5 except that the charge generating substance of the following formula (7T) was used in place of the compound represented by formula (6) used in Example 5.

(7T)

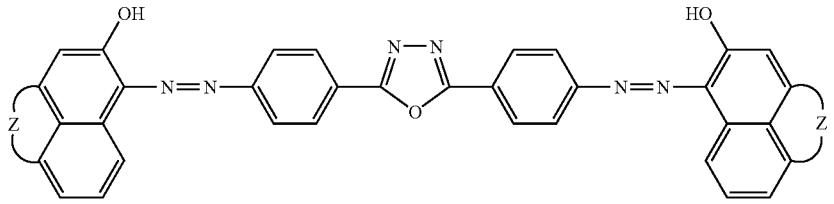

In formula (7T), Z represents

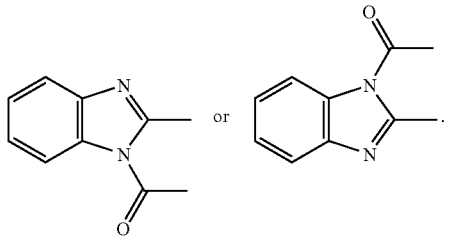

Example 13

An electroconductive support comprising a biaxially stretched polyethylene terephthalate resin film (thickness: 75 μm) having formed on the surface thereof an aluminum-deposited layer (thickness: 700 Å) was used, and the following liquid dispersion for undercoat layer was coated on the deposited layer of the support by a bar coater to have a dry film thickness of 1.25 μm and dried to form a undercoat layer.

The liquid dispersion for undercoat layer was produced as follows. A rutile-type titanium oxide having an average primary particle diameter of 40 nm ("TTO55N", produced by Ishihara Sangyo Kaisha, Ltd.) and methyldimethoxysilane ("TSL8117", produced by Toshiba Silicones) in an amount of 3 wt % based on the titanium oxide were charged into a high-speed fluidized mixing kneader ("SMG300", manufactured by Kawata Co. Inc.) and high-speed mixed at a rotation peripheral velocity of 34.5 m/sec, and the obtained surface-treated titanium oxide was dispersed in a mixed solvent of methanol/l-propanol by a ball mill to form a dispersion slurry of hydrophobed titanium oxide. This dispersion slurry, a mixed solvent of methanol/1-propanol/toluene, and pellets of a copolymerized polyamide comprising ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] at a compositional molar ratio of 75%/9.5%/3%/9.5%/3% were mixed with stirring under heat, thereby dissolving the polyamide pellets, and the resulting mixture was then subjected to an ultrasonic dispersion treatment to obtain a liquid dispersion for undercoat layer containing hydrophobed titanium oxide/copolymerized polyamide at a weight ratio of 3/1 and having a solid content concentration of 18.0%, in which the weight ratio of methanol/1-propanol/toluene was 7/1/2.

A

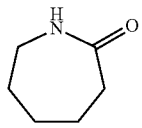

B

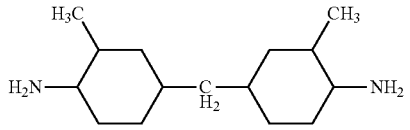

C

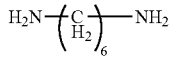

D

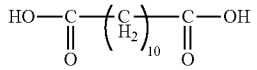

E

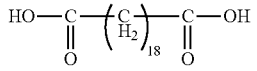

Thereafter, 20 parts by weight of oxytitanium phthalocyanine having a powder X-ray diffraction spectrum pattern shown in FIG. 2 for CuKα characteristic X-ray and 280 parts by weight of 1,2-dimethoxyethane were mixed, and the mixture was ground by a sand grind mill for 2 hours, thereby performing a pulverization and dispersion treatment. Furthermore, this pulverization-treated solution was mixed with a binder solution obtained by dissolving polyvinylbutyral ("Denkabutyral" #6000C, trade name, produced by Denki Kagaku Kogyo K.K.) in a mixed solution containing 253 parts by weight of 1,2-dimethoxyethane and 85 parts by weight of 4-methoxy-4-methyl-2-pentanone and with 234 parts by weight of 1,2-dimethoxyethane to prepare a coating solution for charge generating layer. This coating solution for charge generating layer was coated on the undercoat layer by a bar coater to form a charge generating layer having a dry film thickness of 0.4 μm. Subsequently, the charge transport layer was coated on the charge generating layer in the same manner as in Example 5 to obtain Photoreceptor 12.

Example 14

Photoreceptor J2 was obtained in the same manner as in Example 1 except that the polycarbonate resin having a repeating structure represented by the following formula (8T) and having a viscosity average molecular weight of 50,000 was used in place of the polycarbonate resin having a repeating structure represented by formula (8) used in Example 1.

(8T)

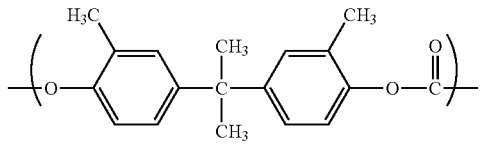

Example 15

Photoreceptor K2 was obtained in the same manner as in Example 14 except that the polycarbonate resin represented by the following formula (9T) having a viscosity average molecular weight of 20,000 was used in place of the polycarbonate resin having a repeating structure represented by formula (8T) used in Example 14.

(9T)

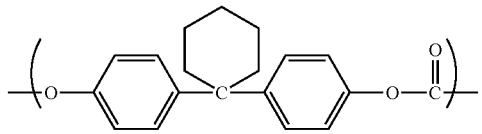

Example 16

Photoreceptor L2 was obtained in the same manner as in Example 14 except that the polycarbonate resin represented by the following formula (10T) having a viscosity average molecular weight of 39,200 was used in place of the polycarbonate resin having a repeating structure represented by formula (8T) used in Example 14.

(10T)

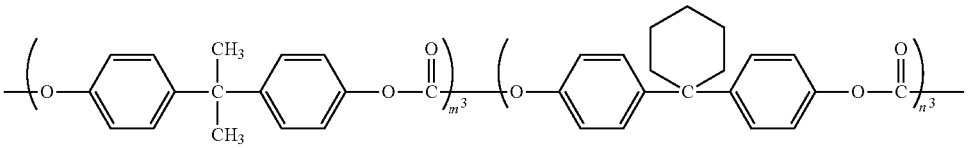

$m^3:n^3 = 9:1$

Example 17

Photoreceptor M2 was obtained in the same manner as in Example 14 except that the polycarbonate resin represented by the following formula (11T) having a viscosity average molecular weight of 38,800 was used in place of the polycarbonate resin having a repeating structure represented by formula (8T) used in Example 14.

(11T)

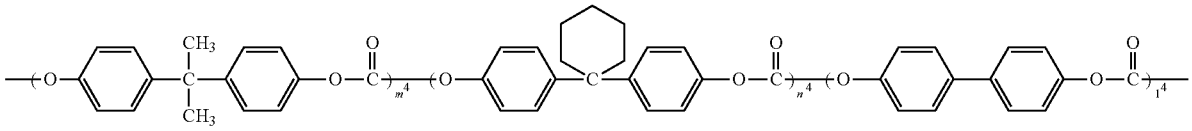

$m^4:n^4:l^4 = 9:9:2$

Example 18

Photoreceptor N2 was obtained in the same manner as in Example 14 except that the polycarbonate resin represented by the following formula (12T) having a viscosity average molecular weight of 39,000 was used in place of the polycarbonate resin having a repeating structure represented by formula (8T) used in Example 14.

(12T)

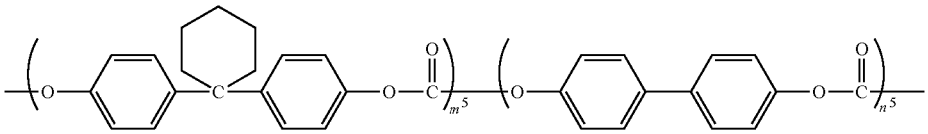

$m^5:n^5 = 9:1$

Example 19

Photoreceptor O2 was obtained in the same manner as in Example 14 except that the polyarylate resin represented by the following formula (13T) having a viscosity average molecular weight of 41,000 was used in place of the polycarbonate resin having a repeating structure represented by formula (8T) used in Example 14.

(13T)

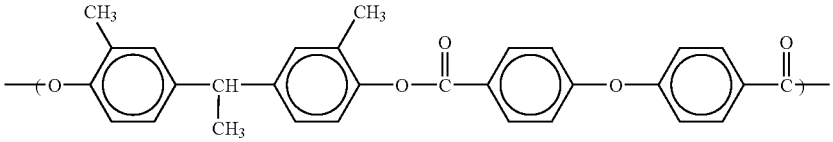

The polyarylate resin represented by formula (13T) was produced as follows.

In a reaction vessel 1, 392 L of demineralized water, 40.58 kg of an aqueous 25% sodium hydroxide solution and 23.01 kg of 1,1-bis(4-hydroxy-3-methylphenyl)ethane were mixed and stirred to prepare an aqueous alkali solution and then, 0.2552 kg of benzyltriethylammonium chloride and 0.6725 kg of 2,3,5-trimethylphenol were sequentially added thereto to prepare a solution of 1,1-bis(4-hydroxy-3-methylphenyl) ethane.

In a reaction vessel 2, 286 kg of dichloromethane and 28.20 kg of diphenylether-4,4'-dicarboxylic acid chloride were mixed and stirred to prepare a dichloromethane solution of diphenylether-4,4'-dicarboxylic acid chloride.

While keeping the outer temperature of the reaction vessel 1 at 20° C. and stirring, he dichloromethane solution of the reaction vessel 2 was charged into the reaction vessel 1 over 1 hour. After stirring of the reaction solution 1 was continued for 4 hours, 468 kg of dichloromethane was added and the stirring was further continued for 8 hours. Thereafter, 3.86 kg of acetic acid was added and after stirring for 30 minutes, the stirring was stopped and the organic phase was separated.

This organic phase was washed with 424 L of an aqueous 0.1N sodium hydroxide solution and after separating the organic phase, centrifugal separation of the organic phase was performed to remove water remaining in the organic phase. Again, the obtained organic phase was washed with 424 L of an aqueous 0.1N sodium hydroxide solution and after separating the organic phase, centrifugal separation of the organic phase was performed to remove water remaining in the organic phase. Furthermore, this organic phase was washed four times with 424 L of 0.1N hydrochloric acid and washed two times with 424 L of demineralized water and then, centrifugal separation of the separated organic phase was performed to remove water remaining in the organic phase. The resin dissolved in the organic phase was extracted by a hot-water granulating apparatus, filtered and dried to obtain 41.7 kg of the polyarylate resin represented by formula (13T).

Comparative Example 4

Photoreceptor P2 was produced in the same manner as in Example 1 except that the compound represented by the following formula (14T) was used in place of the charge transport material represented by formula (7) used in example 1.

(14T)

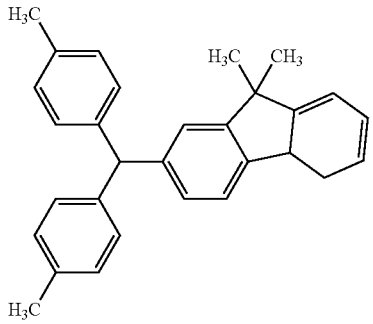

Comparative Example 5

Photoreceptor Q2 was produced in the same manner as in Example 1 except that the compound represented by the following formula (15T) was used in place of the charge transport material represented by formula (7) used in Example 1.

(15T)

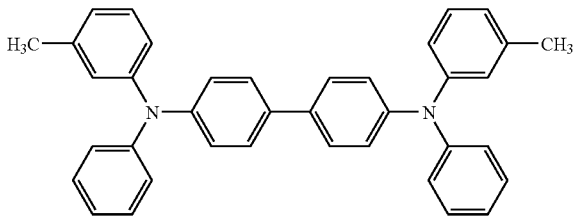

Photoreceptors A2 to Q2 obtained above and Photoreceptor A obtained in Example 1 each was mounted in an electrophotographic characteristic evaluation apparatus (described in *Zoku Denshishashin Gijutsu no Kiso to Ovo* (*Basis and Application of Electrophotographic Technology, sequel*), pp. 404-405, compiled by the Society of Electrophotography, Corona Sha) manufactured in accordance with the measurement standard by the Society of Electrophotography, and the electric properties were evaluated by a cycle of charging, exposure, potential measurement and erasing.

Each photoreceptor was laminated on an aluminum-made drum having an outer diameter of 80 mm, the aluminum-made drum and the aluminum-deposited layer of the photoreceptor were electrically conducted, and the drum was rotated at a constant rotation speed with a rotation number of 30 rpm. The photoreceptor was electrically charged in an environment of a temperature of 25° C. and a humidity of 50% to give an initial surface potential of −700 V and exposed using a halogen lamp of which light was converted into monochromatic light of 400 nm through an interference filter. The exposure dose (hereinafter sometimes referred to as "sensitivity") giving a surface potential of −350 V and the surface potential (hereinafter referred to as "VL") when exposed with a light quantity of 1.11 μJ/cm$^2$ were determined. The time from exposure to potential measurement was set to 389 msec. White light of 75 lux was used for the erasing light, and the exposure width was set to 5 mm. The residual potential (hereinafter referred to as "Vr") after the irradiation of erasing light was measured.

The sensitivity is an exposure dose necessary for the surface potential to become ½ the initial potential and as the numerical value is smaller, the sensitivity is higher. VL is a potential after exposure and Vr is a potential after irradiation of erasing light. In both potentials, a smaller value is more excellent as the electric property. The results when the same azo compound was used and the compound represented by formula (1) was changed are shown in Table 5 below, the results when the same compound was used as the compound represented by formula (1) and the charge generating substance was changed are shown in Table 6 below, and the results when the binder resin used in the photosensitive layer was changed are shown in Table 7 below.

TABLE 5

| | Photoreceptor | Sensitivity (μJ/cm$^2$) | VL (−V) | Vr (−V) |
|---|---|---|---|---|
| Example 1 | A | 0.321 | 12 | 8 |
| Comparative Example 4 | P2 | 0.369 | 12 | 7 |

TABLE 5-continued

| | Photoreceptor | Sensitivity (μJ/cm$^2$) | VL (−V) | Vr (−V) |
|---|---|---|---|---|
| Comparative Example 5 | Q2 | 0.609 | 24 | 9 |

TABLE 6

| | Photoreceptor | Sensitivity (μJ/cm$^2$) | VL (−V) | Vr (−V) |
|---|---|---|---|---|
| Example 5 | A2 | 0.298 | 12 | 9 |
| Example 6 | B2 | 0.743 | — | 9 |
| Example 7 | C2 | 6.739 | — | — |
| Example 8 | D2 | 4.002 | — | 19 |
| Example 9 | E2 | 0.652 | 57 | 14 |
| Example 10 | F2 | 0.539 | 29 | 10 |
| Example 11 | G2 | 2.234 | — | 23 |
| Example 12 | H2 | 0.425 | 16 | 11 |
| Example 13 | I2 | 0.246 | 43 | 25 |

TABLE 7

| | Photoreceptor | Sensitivity (μJ/cm$^2$) | VL (−V) | Vr (−V) |
|---|---|---|---|---|
| Example 14 | J2 | 0.332 | 17 | 11 |
| Example 15 | K2 | 0.284 | 11 | 6 |
| Example 16 | L2 | 0.289 | 17 | 10 |
| Example 17 | M2 | 0.312 | 18 | 8 |
| Example 18 | N2 | 0.292 | 17 | 10 |
| Example 19 | O2 | 0.351 | 18 | 20 |

As seen from the results in Table 5, the electrophotographic photoreceptor where the compound represented by formula (1) according to the present invention is contained in the photosensitive layer and this compound is used as the charge transport layer exhibits high sensitivity in particular at the exposure to monochromatic light of 400 nm as compared with the electrophotographic photoreceptors using conventionally known charge transport materials.

As seen from the results in Table 6, the electrophotographic photoreceptors where the compound represented by formula (1) according to the present invention is used in the photosensitive layer exhibit high sensitivity in particular at the exposure to monochromatic light of 400 nm by using various azo compounds or phthalocyanine compounds as the charge generating substance As seen from the results in Table 7, the electrophotographic photoreceptors where the compound represented by formula (1) according to the present invention and an azo compound are contained in the photosensitive layer exhibit high sensitivity in particular at the exposure to monochromatic light of 400 nm even when the particles are bound by a binder resin of various types, and high sensitivity is achieved particularly when a binder resin having a cyclohexylidene group is used.

Example 20

Photoreceptor R2 was obtained in the same manner as in Example 5 except that oxytitanium phthalocyanine used in Example 13 was used in place of the compound represented by formula (6) used in Example 5.

Example 21

Photoreceptor S2 was obtained in the same manner as in Example 5 except that a coating solution for charge generating layer prepared by mixing 10 parts of the coating solution for charge generating layer prepared in Example 5 and 10 parts of the coating solution for charge generating layer prepared in Example 20 was used in place of the coating solution for charge generating layer used in Example 5.

Photoreceptors R2 and S2 obtained each was mounted in an electrophotographic characteristic evaluation apparatus (described in *Zoku Denshishashin Gijutsu no Kiso to Oyo* (*Basis and Application of Electrophotographic Technology, sequel*), pp. 404-405, compiled by the Society of Electrophotography, Corona Sha) manufactured in accordance with the measurement standard by the Society of Electrophotography, and the electric properties were evaluated by a cycle of charging, exposure, potential measurement and erasing.

Each photoreceptor was laminated on an aluminum-made drum having an outer diameter of 80 mm, the aluminum-made drum and the aluminum-deposited layer of the photoreceptor were electrically conducted, and the drum was rotated at a constant rotation speed with a rotation number of 30 rpm. The photoreceptor was electrically charged in an environment of a temperature of 25° C. and a humidity of 50% to give an initial surface potential of −700 V, and the exposure dose (hereinafter sometimes referred to as "sensitivity") giving a surface potential of −350 V after exposure was determined. The sensitivity is an exposure dose necessary for the surface potential to become ½ the initial potential and as the numerical value is smaller, the sensitivity is higher. Monochromatic light of 400 nm converted from light of a halogen lamp through an interference filter and monochromatic light of 420 nm converted in the same manner were used as the exposure light, and the sensitivity for respective lights was measured. Also, the ratio of the difference between the sensitivity for monochromatic light of 400 nm and the sensitivity for monochromatic light of 420 nm to the sensitivity for monochromatic light of 400 nm was calculated as the sensitivity change ratio (%). The results are shown in Table 8 below.

TABLE 8

| | Photoreceptor | Sensitivity at 400 nm ($\mu J/cm^2$) | Sensitivity at 420 nm ($\mu J/cm^2$) | Sensitivity Change Ratio (%) |
|---|---|---|---|---|
| Example 20 | R2 | 0.250 | 0.423 | 69 |
| Example 21 | S2 | 0.284 | 0.310 | 9 |

As seen from the results in Table 8, either photoreceptor exhibits high sensitivity for the monochromatic light of 400 nm and is revealed to be a high-performance electrophotographic photoreceptor and in particular, the photoreceptor of Example 21 using both an azo pigment and a phthalocyanine pigment is revealed to be a higher-performance photoreceptor where the sensitivity is less changed even by the change of wavelength of the exposure light and stable electric properties are exerted over a wider exposure wavelength range.

While the invention has been described in detail and with reference to specific embodiments thereof, it will be apparent to one skilled in the art that various changes and modifications can be made therein without departing from the spirit and scope of the invention.

This application is based on the Japanese patent application (Application No. 2005-000991) filed on Jan. 5, 2005, the entire contents of which are incorporated herein by reference.

INDUSTRIAL APPLICABILITY

According to the present invention, a photoreceptor assured of high sensitivity, low residual potential and high chargeability can be provided, where fluctuation of these electric properties due to exposure to strong light is small, particularly, the charging stability affecting the image density is good and the durability is excellent. Also, a high-performance image forming apparatus can be provided, where the coating solution for the formation by coating used to form the photosensitive layer has excellent stability and exhibits high sensitivity in the region of 380 to 500 nm and particularly, exposure means comprising a semiconductor laser or LED capable of emitting monochromatic light in that region is used.

The invention claimed is:

1. An electrophotographic photoreceptor comprising an electroconductive support having thereon a photosensitive layer, wherein said photosensitive layer comprises:

a compound represented by the following formula (1):

(1)

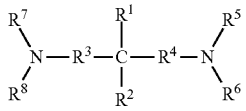

wherein $R^1$ is a group represented by the following formula (2) with a chiral center being the carbon atom designated with a notation "*":

(2)

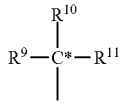

wherein $R^9$, $R^{10}$ and $R^{11}$ are groups different from each other and each represents a hydrogen atom, an alkyl group which may have a substituent, or an alkenyl group which may have a substituent, $R^2$ represents a hydrogen atom, an alkyl group which may have a substituent, or an aryl group which may have a substituent, $R^3$ and $R^4$ each independently represents an alkylene group which may have a substituent, or an arylene group which may have a substituent, and $R^5$, $R^6$, $R^7$ and $R^8$ each independently represents an alkyl group which may have a substituent, or an aryl group which may have a substituent, with the proviso that at least one of $R^5$ to $R^8$ is an aryl group having a substituent; and an azo pigment represented by the following formula (3):

(3)

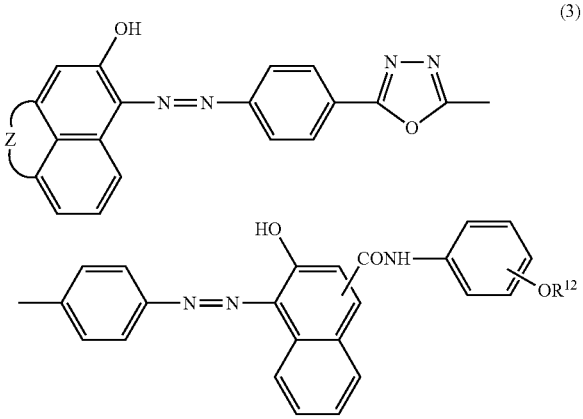

wherein $R^{12}$ represents an alkyl group having a total carbon number of 4 to 20 and having a cycloalkyl group which may have an alkyl substituent, and Z represents

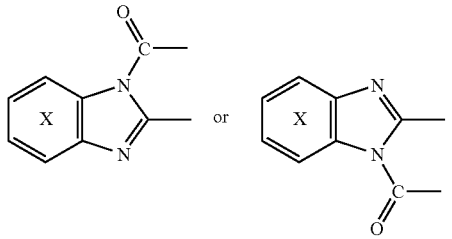

provided that the ring X may have a substituent.

2. The electrophotographic photoreceptor as claimed in claim 1, wherein two out of $R^9$, $R^{10}$ and $R^{11}$ in formula (2) are an alkyl group which may have a substituent, and one is a hydrogen atom.

3. The electrophotographic photoreceptor as claimed in claim 1 or claim 2, wherein in formula (1), $R^3$ and $R^4$ each is a phenylene group and $R^5$, $R^6$, $R^7$ and $R^8$ each is a tolyl group or a xylyl group.

4. The electrophotographic photoreceptor as claimed in claim 1, wherein said azo pigment is a compound represented by the following formula (3):

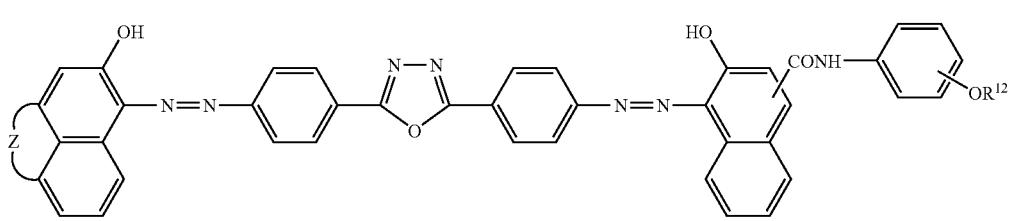

(3)

wherein $R^{12}$ represents an alkyl group having a total carbon number of 4 to 20 and having a cycloalkyl group which may have an alkyl substituent, and Z represents

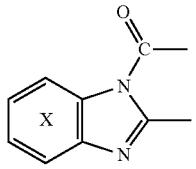

provided that the ring X may have a substituent.

5. The electrophotographic photoreceptor as claimed in claim 1, wherein said azo pigment is a compound represented by the following formula (3):

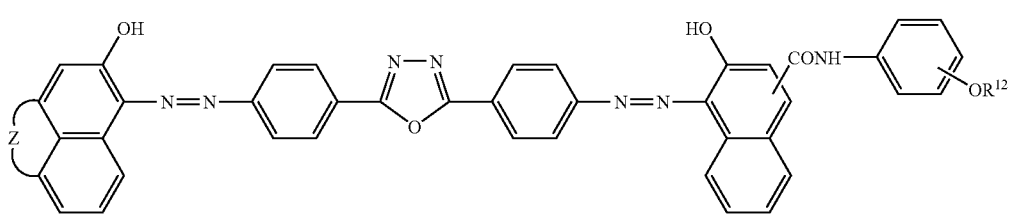

(3)

wherein $R^{12}$ represents an alkyl group having a total carbon number of 4 to 20 and having a cycloalkyl group which may have an alkyl substituent, and Z represents

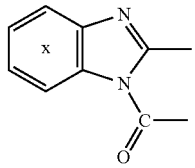

provided that the ring X may have a substituent.

6. The electrophotographic photoreceptor as claimed in claim 1, wherein said photosensitive layer further comprises a phthalocyanine pigment.

7. The electrophotographic photoreceptor as claimed in claim 6, wherein said phthalocyanine pigment is oxytitanium phthalocyanine.

8. The electrophotographic photoreceptor as claimed in claim 4, wherein said photosensitive layer further comprises a phthalocyanine pigment.

9. The electrophotographic photoreceptor as claimed in claim 5, wherein said photosensitive layer further comprises a phthalocyanine pigment.

10. The electrophotographic photoreceptor as claimed in claim 8, wherein said phthalocyanine pigment is oxytitanium phthalocyanine.

11. The electrophotographic photoreceptor as claimed in claim 9, wherein said phthalocyanine pigment is oxytitanium phthalocyanine.

12. An image forming apparatus mounting the electrophotographic photoreceptor claimed in claim 1, wherein an image is formed by exposing said electrophotographic photoreceptor with monochromatic light at a wavelength of 380 to 500 nm.

13. An image forming apparatus mounting the electrophotographic photoreceptor claimed in claim 4, wherein an image is formed by exposing said electrophotographic photoreceptor with monochromatic light at a wavelength of 380 to 500 nm.

14. An image forming apparatus mounting the electrophotographic photoreceptor claimed in claim 5, wherein an image is formed by exposing said electrophotographic photoreceptor with monochromatic light at a wavelength of 380 to 500 nm.

15. An image forming apparatus mounting the electrophotographic photoreceptor claimed in claim 6, wherein an image is formed by exposing said electrophotographic photoreceptor with monochromatic light at a wavelength of 380 to 500 nm.

* * * * *

UNITED STATES PATENT AND TRADEMARK OFFICE

CERTIFICATE OF CORRECTION

PATENT NO. : 8,288,066 B2
APPLICATION NO. : 11/794724
DATED : October 16, 2012
INVENTOR(S) : Yuka Nagao et al.

It is certified that error appears in the above-identified patent and that said Letters Patent is hereby corrected as shown below:

On the title page, Item (86), the PCT information is incorrect. Item (86) should read:

-- (86) PCT No.: PCT/JP2006/300045

§ 371 (c)(1),
(2), (4) Date: Jul. 25, 2007 --

Signed and Sealed this
Fourth Day of December, 2012

David J. Kappos

David J. Kappos
*Director of the United States Patent and Trademark Office*